US006846232B2

(12) United States Patent
Braunschweig et al.

(10) Patent No.: US 6,846,232 B2
(45) Date of Patent: Jan. 25, 2005

(54) BACKING AND ABRASIVE PRODUCT MADE WITH THE BACKING AND METHOD OF MAKING AND USING THE BACKING AND ABRASIVE PRODUCT

(75) Inventors: Ehrich J. Braunschweig, Woodbury, MN (US); Daidre L. Syverson, Roseville, MN (US); Edward J. Woo, Woodbury, MN (US); Michael J. Annen, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 164 days.

(21) Appl. No.: 10/033,436

(22) Filed: Dec. 28, 2001

(65) Prior Publication Data

US 2003/0143938 A1 Jul. 31, 2003

(51) Int. Cl.[7] ..... B24D 11/00

(52) U.S. Cl. ..... 451/528; 451/526; 451/530; 451/532; 451/534; 451/539; 51/295; 51/307

(58) Field of Search ..... 451/526, 528, 451/530, 532, 534, 539; 51/295, 307

(56) References Cited

U.S. PATENT DOCUMENTS

| | | | |
|---|---|---|---|
| 1,910,444 | A | 5/1933 | Nicholson |
| 2,115,897 | A | 5/1938 | Wooddell et al. |
| 2,242,877 | A | 5/1941 | Albertson |
| 2,755,607 | A | 7/1956 | Haywood |
| 3,041,156 | A | 6/1962 | Rowse et al. |
| 3,048,482 | A | 8/1962 | Hurst |
| 3,498,010 | A | 3/1970 | Hagihara |
| 3,594,865 | A | 7/1971 | Erb |
| 3,605,349 | A | 9/1971 | Anthon |
| 3,976,525 | A | 8/1976 | Mednick |
| 4,255,164 | A | 3/1981 | Butzke et al. |
| 4,311,489 | A | 1/1982 | Kressner |

(List continued on next page.)

FOREIGN PATENT DOCUMENTS

| | | |
|---|---|---|
| EP | 0 302 162 B1 | 3/1989 |
| EP | 0 306 161 A2 | 3/1989 |
| EP | 0 771 613 B1 | 5/1997 |
| EP | 0 702 615 B1 | 10/1997 |
| GB | 2 094 824 A | 9/1982 |
| JP | 62-238724 A | 10/1987 |
| JP | 2083172 A | 3/1990 |
| JP | 4-159084 | 6/1992 |
| WO | WO 95/00295 | 1/1995 |
| WO | WO 00/03840 | 1/2000 |
| WO | WO 02/42034 A1 | 5/2002 |

*Primary Examiner*—Joseph J. Hail, III
*Assistant Examiner*—Shantese L. McDonald
(74) *Attorney, Agent, or Firm*—Richard Francis; Gregory D. Allen

(57) ABSTRACT

The invention provides a backing for an abrasive article comprising a sheet-like polymeric substrate having a first major surface including a pattern of non-abrasive raised areas and depressed areas and an opposite second major surface including a plurality of shaped engaging elements that are one part of a two-part mechanical engagement system. An abrasive product is provided by coating at least the raised areas of the backing with an abrasive coating.

16 Claims, 6 Drawing Sheets

U.S. PATENT DOCUMENTS 4,314,827 A 2/1982 Leitheiser et al.
4,318,766 A 3/1982 Smith
4,609,581 A 9/1986 Ott
4,623,364 A 11/1986 Cottringer et al.
4,644,703 A 2/1987 Kaczmarek et al.
4,652,274 A 3/1987 Boettcher et al.
4,652,275 A 3/1987 Bloecher et al.
4,735,632 A 4/1988 Oxman et al.
4,744,802 A 5/1988 Schwabel
4,751,138 A 6/1988 Tumey et al.
4,770,671 A 9/1988 Monroe et al.
4,773,920 A 9/1988 Chasman et al.
4,799,939 A 1/1989 Bloecher et al.
4,881,951 A 11/1989 Wood et al.
4,903,440 A 2/1990 Larson et al.
4,930,266 A 6/1990 Calhoun et al.
4,950,696 A 8/1990 Palazotto et al.
4,959,265 A 9/1990 Wood et al.
4,985,340 A 1/1991 Palazzotto et al.
4,997,461 A 3/1991 Markhoff-Matheny et al.
5,007,128 A 4/1991 Englund et al.
5,009,675 A 4/1991 Kunz et al.
5,011,508 A 4/1991 Wald et al.
5,014,468 A * 5/1991 Ravipati et al. ..... 51/295
5,015,266 A 5/1991 Yamamoto
5,042,991 A 8/1991 Kunz et al.
5,077,870 A 1/1992 Melbye et al.
5,085,671 A 2/1992 Martin et al.
5,107,626 A 4/1992 Mucci
5,152,917 A 10/1992 Pieper et al.
5,178,646 A 1/1993 Barber, Jr. et al.
5,190,568 A 3/1993 Tselesin
5,197,249 A * 3/1993 Wiand ..... 451/529
5,199,227 A 4/1993 Ohishi
5,213,591 A 5/1993 Celikkaya et al.
5,219,462 A 6/1993 Bruxvoort et al.
5,236,472 A 8/1993 Kirk et al.
5,247,765 A * 9/1993 Quintana ..... 451/548
5,254,194 A 10/1993 Ott et al.
5,256,170 A 10/1993 Harmer et al.
5,304,223 A 4/1994 Pieper et al.
5,316,812 A * 5/1994 Stout et al. ..... 428/64
5,368,619 A 11/1994 Culler
5,378,252 A 1/1995 Follensbee
5,396,737 A 3/1995 Englund et al.
5,417,726 A 5/1995 Stout et al.
5,435,816 A 7/1995 Spurgeon et al.
5,437,754 A 8/1995 Calhoun
5,454,844 A 10/1995 Hibbard et al.
5,500,273 A 3/1996 Holmes et al.
5,505,747 A 4/1996 Chesley et al.
5,573,619 A 11/1996 Benedict et al.
5,667,540 A 9/1997 Chesley
5,672,097 A 9/1997 Hoopman
5,672,186 A 9/1997 Chesley et al.
5,674,122 A 10/1997 Krech et al.
5,681,217 A 10/1997 Hoopman et al.
5,690,875 A 11/1997 Sakakibara et al.
5,714,259 A 2/1998 Holmes et al.
5,785,784 A 7/1998 Chesley et al.
5,849,051 A 12/1998 Beardsley et al.
5,910,471 A 6/1999 Christianson et al.
5,922,784 A * 7/1999 DeVoe et al. ..... 522/165
5,954,844 A * 9/1999 Law et al. ..... 51/306
5,958,794 A 9/1999 Bruxvoort et al.
5,962,102 A 10/1999 Sheffield et al.
5,975,987 A 11/1999 Hoopman et al.
6,007,407 A 12/1999 Rutherford et al.
6,024,634 A 2/2000 Höglund et al.
6,059,850 A 5/2000 Lise et al.
6,162,522 A 12/2000 Deka et al.
6,197,076 B1 3/2001 Braunschweig et al.
6,299,508 B1 10/2001 Gagliardi et al.
6,303,062 B1 10/2001 Aamodt et al.
6,371,842 B1 * 4/2002 Romero ..... 451/540
6,375,559 B1 4/2002 James et al.

* cited by examiner

BACKING AND ABRASIVE PRODUCT MADE WITH THE BACKING AND METHOD OF MAKING AND USING THE BACKING AND ABRASIVE PRODUCT

FIELD OF THE INVENTION

The present invention relates generally to the backing for an abrasive product, a method of making the backing, and abrasive product including the backing, a method of making the abrasive product and a method of using the abrasive product.

BACKGROUND OF THE INVENTION

Coated abrasive products typically include a flexible backing material which is overcoated with an abrasive coating. The abrasive coating commonly includes a first coating, typically called a "make" coating which is first applied to the upper surface of the backing and, while the make coating is still sufficiently uncured, abrasive particles are deposited into the make coating to become partially embedded therein. The make coating is then at least partially cured and the abrasive particles are typically further secured within the coated abrasive product by the addition of a size coating which overlays the make coating and the abrasive particles. Following a full curing of the make and size coatings, a coated abrasive product is produced. A coated abrasive product may also include an abrasive product made by applying to one surface of the backing a blend of abrasive particles in a curable binder. The blend is typically coated by suitable means over the upper surface of the backing and then cured. The surface of the abrasive coating may also be modified prior to curing to include raised portions and depressed portions to give a three-dimensional or structured abrasive surface.

In some instances, it is desirable to actually impart a three-dimensional surface to the backing, instead of imparting it to the abrasive coating itself If the backing is imparted with a three-dimensional surface the resultant surface on which the abrasive coating is applied typically includes depressed portions and raised portions which are commonly flat in the raised areas with the raised areas generally being deployed in the same plane to provide a discontinuous abrasive surface.

Most coated abrasive products are converted into any of a variety of shapes such as rectangular sheets, disc shapes, elongate strips and elongate strips which are fastened on ends to provide an abrasive belt. Abrasive discs are typically utilized in sanding devices such as an orbital sander and thus require on their non-abrasive side some means of attaching the coated abrasive disc the movable pad contained on the sanding device. It is fairly commonplace to put a coating of a pressure sensitive adhesive composition either on the non-abrasive side of the abrasive disc or on the support pad to which it is applied with the surface to which it is to be attached being a surface which is adapted to provide a good adhesive bond between the adhesive coating and the surface. Other mechanical attachment systems are known. For example, the backside of the abrasive article may contain a loop substrate. The purpose of the loop substrate is to provide a means for an abrasive product such as a disc to be securely engaged with hooks on a support pad. Moreover, a sheet which includes erect filament stems which have had their distal ends flattened may also be employed as an engagement device for engagement with a loop substrate. The loop substrate may either be applied to the backside of the abrasive sheet material or to the support to which it will be attached, with the other side being the engaging member, i.e., a sheet which includes a multiplicity of hooks or stems with flattened distal ends.

Prior to the present invention a manufacturer of an abrasive sheet material which included (1) a backing having a raised portions and depressed portions on the surface which is to be coated with an abrasive coating and (2) on the backside of the backing to which one part of a two part mechanical engagement system is to be applied was required to accomplish this result in a multi-step operation. Typically, the backing was first prepared with raised areas and depressed areas. Then the abrasive coating was applied at least to the raised areas. A subsequent operation was required to laminate a sheet material which included one part of a two part mechanical engagement system such as a sheet bearing hooks or the stems with distal ends flattened.

RELATED ART

U.S. Pat. No. 2,115,897 (Wooddell et al.) teaches an abrasive article having a backing having attached thereto by an adhesive a plurality of bonded abrasive segments. These bonded abrasive segments can be adhesively secured to the backing in a specified pattern.

U.S. Pat. No. 2,242,877 (Albertson) teaches a method of making a compressed abrasive disc. Several layers of coated abrasive fibre discs are placed in a mold and then subjected to heat and pressure to form the compressed center disc. The mold has a specified pattern, which then transfers to the compressed center disc, thus rendering a pattern coated abrasive article.

U.S. Pat. No. 2,755,607 (Haywood) teaches a coated abrasive in which there are lands and grooves of abrasive portions. An adhesive coat is applied to the front surface of a backing and this adhesive coat is then combed to create peaks and valleys. Next abrasive grains are projected into the adhesive followed by solidification of the adhesive coat.

U.S. Pat. No. 3,048,482 (Hurst) discloses an abrasive article comprising a backing, a bond system and abrasive granules that are secured to the backing by the bond system. The abrasive granules are a composite of abrasive grains and a binder which is separate from the bond system. The abrasive granules are three dimensional and are preferably pyramidal in shape. To make this abrasive article, the abrasive granules are first made via a molding process. Next, a backing is placed in a mold, followed by the bond system and the abrasive granules. The mold has patternized cavities therein which result in the abrasive granules having a specified pattern on the backing.

U.S. Pat. No. 3,498,010 (Hagihara) describes a flexible grinding disc comprising an abrasive filled cured resin composite. The disc further comprises a structured surface formed by a molding process.

U.S. Pat. No. 3,605,349 (Anthon) pertains to a lapping type abrasive article. Binder and abrasive grain are mixed together and then sprayed onto the backing through a grid. The presence of the grid results in a patterned abrasive coating.

Great Britain Patent Application No. 2,094,824 (Moore) pertains to a patterned lapping film. The abrasive/binder resin slurry is prepared and the slurry is applied through a mask to form discrete islands. Next, the binder resin is cured. The mask may be a silk screen, stencil, wire or a mesh.

U.S. Pat. No. 4,644,703 (Kaczmarek et al.) and U.S. Pat. No. 4,773,920 (Chasman et al.) concern a lapping abrasive article comprising a backing and an abrasive coating adhered to the backing. The abrasive coating comprises a suspension of lapping size abrasive grains and a binder cured by free radical polymerization. The abrasive coating can be shaped into a pattern by a rotogravure roll.

Japanese Patent Application No. JP 62-238724A (Shigeharu, published Oct. 19, 1987) describes a method of forming a large number of intermittent protrusions on a substrate. Beads of pre-cured resin are extrusion molded simultaneously on both sides of the plate and subsequently cured.

U.S. Pat. No. 4,930,266 (Calhoun et al.) teaches a patterned abrasive sheeting in which the abrasive granules are strongly bonded and lie substantially in a plane at a predetermined lateral spacing. In this invention the abrasive granules are applied via a impingement technique so that each granule is essentially individually applied to the abrasive backing. This results in an abrasive sheeting having a precisely controlled spacing of the abrasive granules.

Japanese Patent Application No. 02-083172 (Tsukada et al., published Mar. 23, 1990) teaches a method of a making a lapping film having a specified pattern. An abrasive/binder slurry is coated into indentations in a tool. A backing is then applied over the tool and the binder in the abrasive slurry is cured. Next, the resulting coated abrasive is removed from the tool. The binder can be cured by radiation energy or thermal energy.

U.S. Pat. No. 5,014,468 (Ravipati et al.) pertains to a lapping film intended for ophthalmic applications. The lapping film comprises a patterned surface coating of abrasive grains dispersed in a radiation cured adhesive binder. To make the patterned surface an abrasive/curable binder slurry is shaped on the surface of a rotogravure roll, the shaped slurry removed from the roll surface and then subjected to radiation energy for curing.

U.S. Pat. No. 5,015,266 (Yamamoto) pertains to an abrasive sheet by uniformly coating an abrasive/adhesive slurry over an embossed sheet to provide an abrasive coating which on curing has high and low abrasive portions formed by the surface tension of the slurry, corresponding to the irregularities of the base sheet.

U.S. Pat. No. 5,107,626 (Mucci) teaches a method of providing a patterned surface on a substrate by abrading with a coated abrasive containing a plurality of precisely shaped abrasive composites. The abrasive composites are in a non-random array and each composite comprises a plurality of abrasive grains dispersed in a binder.

Japanese Patent Application No. JP 4-159084 (Nishio et al., published Jun. 2, 1992) teaches a method of making a lapping tape. An abrasive slurry comprising abrasive grains and an electron beam curable resin is applied to the surface of an intaglio roll or indentation plate. Then, the abrasive slurry is exposed to an electron beam which cures the binder and the resulting lapping tape is removed from the roll.

U.S. Pat. No. 5,190,568 (Tselesin) describes a coated abrasive having a plurality of peaks and valleys. Abrasive particles are embedded in and on the surface of the composite structure.

U.S. Pat. No. 5,199,227 (Ohishi) describes a surface treating tape comprising a plurality of particulate filled resin protuberances on a substrate. The protuberances are closely spaced Bernard cells coated with a layer of premium abrasive particles.

U.S. Pat. No. 5,437,754 (Calhoun), assigned to the same assignee as the present application, teaches a method of making an abrasive article. An abrasive slurry is coated into recesses of an embossed substrate. The resulting construction is laminated to a backing and the binder in the abrasive slurry is cured. The embossed substrate is removed and the abrasive slurry adheres to the backing.

U.S. Pat. No. 5,219,462 (Bruxvoort et al.), assigned to the same assignee as the present application, teaches a method for making an abrasive article. An abrasive/binder/expanding agent slurry is coated substantially only into the recesses of an embossed backing. After coating, the binder is cured and the expanding agent is activated. This causes the slurry to expand above the surface of the embossed backing.

U.S. Pat. No. 5,435,816 (Spurgeon et al.), assigned to the same assignee as the present application, teaches a method of making an abrasive article. In one aspect of this patent application, an abrasive/binder slurry is coated into recesses of an embossed substrate. Radiation energy is transmitted through the embossed substrate and into the abrasive slurry to cure the binder.

U.S. Pat. No. 5,672,097 (Hoopman), assigned to the same assignee as the present application, teaches an abrasive article where the features are precisely shaped but vary among themselves.

European Patent No. 702,615 (Romero, published Oct. 22, 1997) describes an abrasive article having a patterned abrasive surface. The abrasive article has a plurality of raised and recessed portions comprising a thermoplastic material, the raised portions further comprising a layer of adhesive and abrasive material while the recessed portions are devoid of abrasive material.

U.S. Pat. No. 5,690,875 (Sakakibara et al.) describes a method and apparatus for making a molded mechanical fastener. A die wheel having engaging element forming cavities extrusion molds a thermoplastic resin. The die wheel has a cooling means that provides for removal of the engaging elements from the die with a substantially uniform peeling force, thereby preventing deformation of the substrate.

U.S. Pat. No. 5,785,784 (Chesley et al.) pertains to an abrasive article having a first and a second, opposite, major surface. A mechanical fastener is formed on one surface and precisely shaped abrasive composites are applied via a production tool on the opposite major surface.

U.S. Pat. No. 6,299,508 (Gagliardi et al.) describes an abrasive article having a plurality of grinding-aid containing protrusions integrally molded to the surface of a backing. The protrusions are contoured so as to define a plurality of peaks and valleys, wherein abrasive particles cover at least a portion of the peaks and valleys.

U.S. Pat. No. 6,303,062 (Aamodt et al.) discloses a mechanical fastener wherein the engaging elements include convex heads having demarcation lines. The convex heads are formed by applying a layer of heated material over the stem ends.

SUMMARY OF THE INVENTION

The present invention provides a novel backing for an abrasive article. The backing is made essentially in a single step to include a major surface bearing raised areas and depressed areas upon which an abrasive coating will be applied and opposite major surface which includes a plurality of shaped engaging elements that are one part of a two-part mechanical fastening system.

In a first embodiment, the invention provides a backing for an abrasive article comprising a sheet-like polymeric substrate having a first major surface including a pattern of nonabrasive raised areas and depressed areas and an opposite second major surface including a plurality of shaped engaging elements that are one part of a two-part mechanical engagement system. The pattern on the first major surface may either be a uniform pattern or a random pattern. The engaging elements may comprise filament stems having flattened distal ends integrally shaped into the second major surface or they may comprise hook elements integrally shaped into the second major surface.

In a further embodiment, the invention provides an abrasive article comprising:

a backing comprising a sheet-like polymeric substrate having a first major surface including a pattern of nonabrasive raised areas and depressed areas and an opposite second major surface including a plurality of shaped engaging elements that are one part of a two-part mechanical engagement system; and an abrasive coating at least over the raised areas.

The raised areas are preferably deployed in the same plane to provide a discontinuous abrasive surface. The abrasive coating may coat the entire first major surface including depressed areas and raised areas although the preferred configuration is to just coat the raised areas.

The abrasive coating may comprise the mixture of abrasive particles and binder and curable binder, which, when applied to the first major surface will cure to provide a uniform abrasive coating. The coating may be modified prior to curing to impart raised areas and depressed areas therein to provide a shaped or structured abrasive coating.

The engaging elements may comprise filament stems integrally shaped into such second major surface, each stem having a flattened distal end or hook elements, each stem or hook element being integrally shaped into the second major surface.

The abrasive coating may comprise a binder make coating into which at least a portion of each abrasive particle is embedded and may further include a size coating over the make coating and abrasive particles.

In a further embodiment, the invention provides a method of making a backing for an abrasive article. The method comprises:

extruding molten polymeric material to form a molten polymer sheet having a first major surface and an opposite second major surface;

contacting the first major surface of the molten polymer sheet with a first tool having a contact surface including a pattern of raised areas and depressed areas to create in the first major surface a corresponding pattern of depressed areas and raised areas;

contacting the second major surface of the molten polymer sheet with a second tool having a contact surface capable of creating therein a plurality of elements selected from the group consisting of shaped engaging elements and precursors to shaped engaging elements that will be one part of a two-part mechanical engagement system;

solidifying the molten polymer sheet to provide the backing; and forming any precursors of engaging elements into engaging elements.

Preferably, the steps of forming the pattern of raised and depressed areas of the first surface and forming the engaging elements that are precursors to engaging elements in the second major surface are carried out simultaneously. The polymer sheet may be a co-extruded polymer sheet comprising at least two different polymer materials with each polymer material comprising a layer in the polymer sheet.

The precursors to shaped engaging elements are preferably erect stems which are further processed after formation to flatten their distal ends to provide a flat head portion which is engageable with a looped fabric. Alternatively, the engaging elements may be formed into hooks by using an appropriately shaped formation cavity on the surface of the second tool which will in situ form hooks as the filament strands are withdrawn from the openings contained in the contact surface of the second tool. Alternatively, the hooks may also be formed into an erect configuration and later softened and deployed appropriately into a hook shape with an appropriate tool.

An abrasive coating is applied at least over the raised areas of the first surface to provide a discontinuous abrasive surface. As previously mentioned, the abrasive coating may either be a blend of abrasive particles and curable binder which may either be applied in a smooth configuration or a shaped or structured configuration or it may be a conventional make and size coated abrasive coating.

And in further aspect, the invention provides a method of making an abrasive article. The method comprises:

extruding molten polymeric material to form a molten polymer sheet having a first major surface and an opposite second major surface;

contacting the first major surface of the molten polymer sheet with the first tool having a contact surface including a pattern of raised areas and depressed areas to create in the first major surface a corresponding pattern of depressed areas and raised areas;

contacting the second major surface of the molten polymer sheet material with a second tool having a contact surface capable of creating therein a plurality of elements selected from the group consisting of shaped engaging elements and precursors to shaped engaging elements that will be one part of a two-part mechanical engagement system;

solidifying the molten polymer sheet to provide the backing;

forming any precursors to engaging elements into engaging elements; and providing an abrasive coating at least over the raised areas of the first major surface.

The abrasive coating may be provided by coating at least the raised areas of the first major surface with a make coating of curable binder composition, depositing abrasive particles into the make coating of curable binder composition and at least partially curing the make coating binder composition. Preferably, a curable size coating composition is coated over the make coating and abrasive particles and the make and size coating compositions are then fully cured by appropriate processes.

In a further embodiment, the invention provides a method of abrading a workpiece comprising:

contacting the abrasive coating of an abrasive article comprising a backing comprising a sheet-like polymeric substrate having a first major surface including a pattern of raised areas and depressed areas in an opposite second major surface including a plurality of shaped engaging elements that are one part of a two-part mechanical engagement system;

an abrasive coating at least over the raised areas; and moving at least one of the abrasive article or the workpiece to abrade the contacted surface of the workpiece.

The workpiece may be formed of any material, for example, a material selected from the group consisting of metal, wood, plastic and composites. The workpiece may also be a painted workpiece which may be abraded to provide a surface which will be repainted.

The abrasive article of the invention may be converted into any of a variety of conventionally shaped abrasive products such as abrasive discs, abrasive belts and rectangular abrasive sheets. The preferred shape of the abrasive article of the invention is in the shape of a pad which may be round to fit conventional orbital sanders or similar devices which would have a support pad for receiving the mechanical engaging element formed on the second major surface. The support pad would include the mating element for the element provided on the second major surface of the abrasive article.

BRIEF DESCRIPTION OF DRAWINGS

The present invention is further illustrated by reference to FIGS. 1–10 of the drawing wherein.

It should be noted that none of the drawings shown above are intended to be according to scale and certain features are shown to be exaggerated for purposes of more clearly understanding the invention.

DETAILED DESCRIPTION

Figure 1:
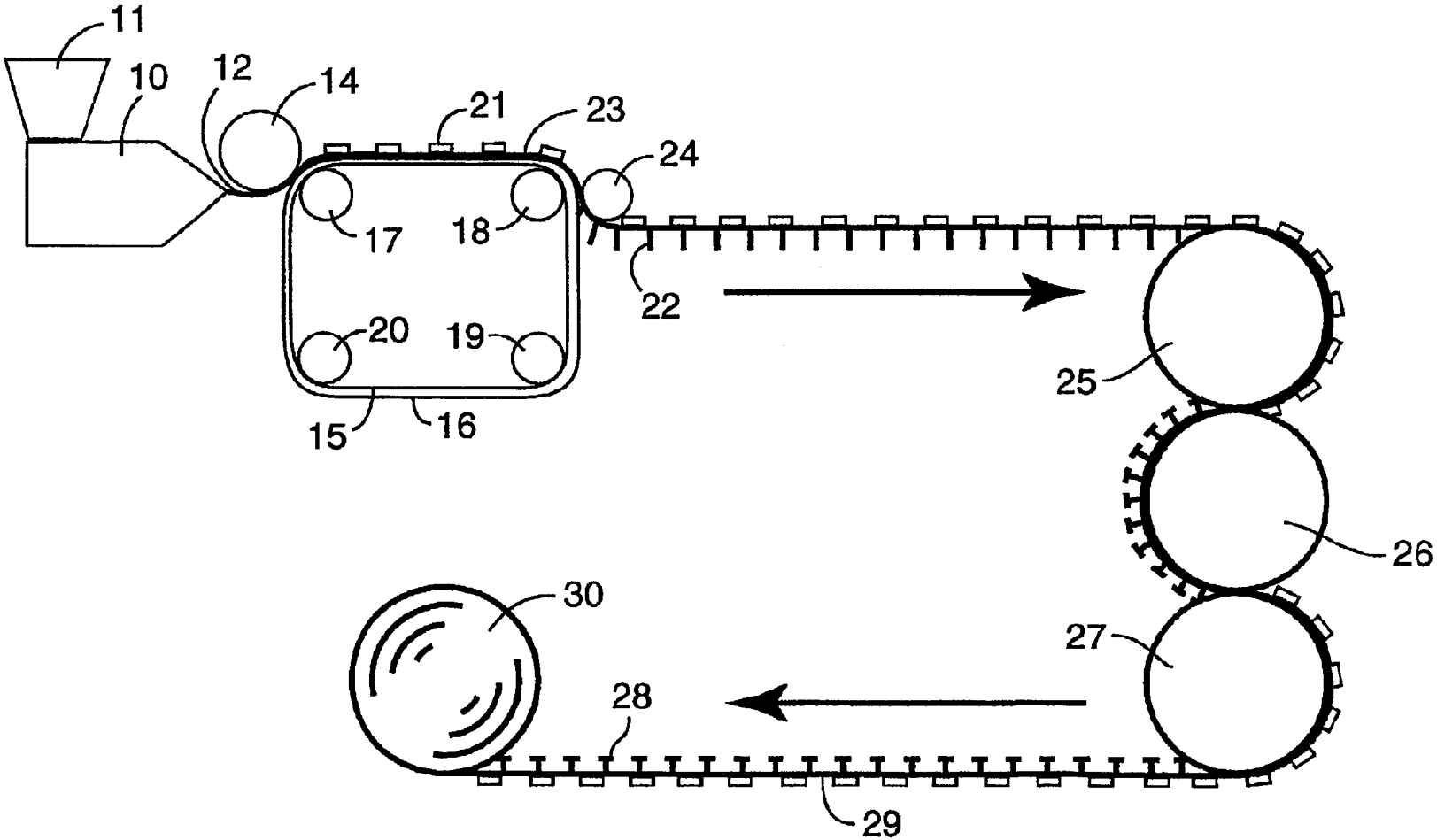
FIG. 1 is a schematic drawn representation depicting the process and apparatus for forming the backing of the invention.

Referring now to FIG. 1 there shown an extruder 10 which includes a hopper 11 into which particulate polymeric material may be introduced into the extruder. The extruder may be any conventional commercial extruder for this purpose which has the capability of melting and forming a molten polymer sheet from an appropriate extruder die to produce molten polymer sheet 12 which is conducted between patterned roll 14 and the cavity-bearing surface 16 of belt 15. The preferred extruder is that available under the commercial designation "SINGLE SCREW EXTRUDER", available from Johnson Plastic Machinery Co., Chippewa Falls, Wis., fitted with the extruder die having an opening capable of forming a molten sheet of material. The operating conditions for the extruder were as follows:

The extruder die was heated at 248.9° C. and had an opening of 12.7 mm (0.5 inches). The polymeric material was heated at a rate of 26.7° C. per minute in the extruder.

Patterned roll 14 heated at 18° C. and composed of steel was rotated at 8.2 m/min. Steel patterned roll 14, maintained at 18.3° C., included a staggered pyramid pattern on its cylindrical surface having approximately 1,783 pyramids/$cm^2$ (11,500 pyramids/$inch^2$). Patterned roll 14 was rotated at 8.2 m/min.

Belt 15 having a cavity-bearing surface 16 capable of forming erect filaments was conducted over roll set 17, 18, 19 and 20, respectively. A nip was formed between the patterned surface roll 14 and cavity-bearing surface 16 of belt 15 borne on roll 17, respectively, such that the upper surface of molten sheet 12 was provided with a plurality of raised portions 21 simultaneously as stems 22 were formed in belt surface 16. The resultant shaped backing 23 bearing raised portions 21 on its upper surface and filament stems 22 on its lower surface was permitted to solidify and conducted over idler roll 18 and under idler roll 24 which was spaced from the stem-forming belt surface 16 so that stems 22 were stripped from their formation openings in surface 16 of belt 15. The backing bearing hooking element precursor stems 22 was then conducted in a serpentine fashion around three stacked rollers 25, 26, and 27, respectively, to flatten the distal ends of erect stems 22 to provide flattened stems 28. Roll 25 was heated at 143° C., rotated clockwise at 8.2 m/min and was composed of steel. Roll 26 was chilled at 10° C., rotated clockwise at 8.2 m/min and was composed of steel. Roll 27 was heated at 143° C., rotated clockwise at 8.2 m/min and was composed of steel. After forming the flattened distal ends to provide flattened stems 28, the resultant backing material 29 was wound for storage as roll 30.

Figure 2:
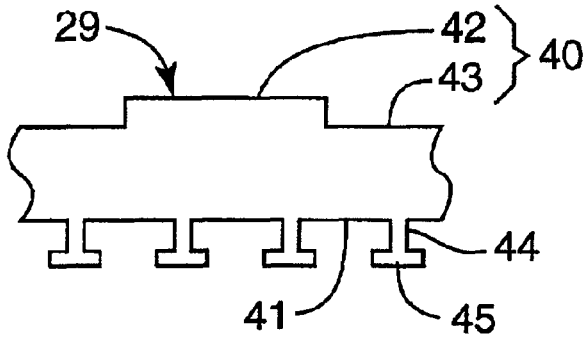
FIG. 2 is an enlarged schematic cross-sectional drawn representation of a portion of an abrasive backing product according to the present invention.

FIG. 2 is an enlarged schematic cross-sectional drawn representation of a portion of backing 29 showing upper surface 40 and lower surface 41. Upper surface 40 includes raised areas 42 and depressed areas 43. Lower surface 41 includes erect stems 44 having flattened distal ends 45 for engagement with a looped fabric substrate. The method of making the plurality of shaped engaging elements that are one part of a two-part mechanical fastening system as used on the second major surface of the backing is described in U.S. Pat. No. 5,785,784 (Chesley et al), which is incorporated herein by reference.

In the apparatus depicted in FIG. 1, endless belt 15 is a production tool having a surface 16 which is capable of producing the erect stems 22 from a molten thermoplastic material. The preferred molten thermoplastic material is polypropylene available under the commercial designation "SRD7587" from Dow Chemical Company, Midland, Mich.

Figure 3:
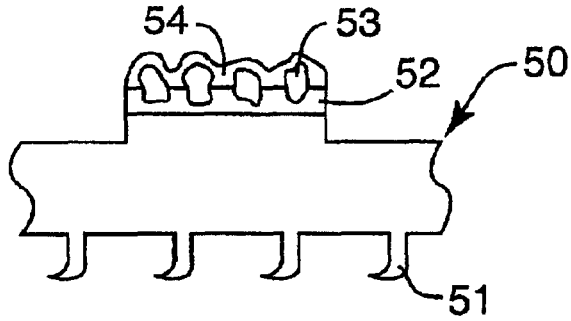
FIG. 3 is an enlarged schematic cross-sectional drawn representation of a portion of another embodiment of an abrasive product according to the present invention.

FIG. 3 is an enlarged schematic cross-sectional drawn representation of a portion of an abrasive product 50 in accordance with the present invention. The backing depicted in FIG. 3 is similar to that shown in FIG. 2 with an upper surface with raised and depressed areas and lower surface which includes one part of a two-part mechanical fastening system. In the case of FIG. 3 the one part of the mechanical fastening system includes hook elements 51. In the case of FIG. 3 the abrasive coating includes a make coat 52 into which are embedded abrasive particles 53 which is then overcoated with size coating 54.

Figure 4:
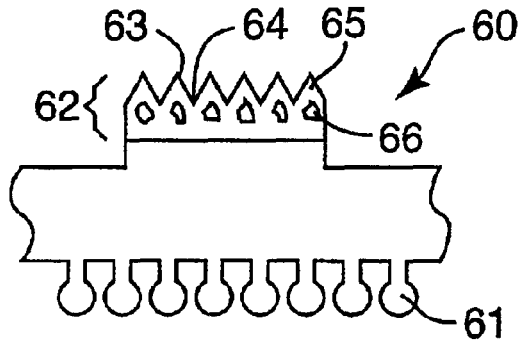
FIG. 4 is an enlarged schematic cross-sectional drawn representation of a portion of a further embodiment of an abrasive product having a shaped abrasive coating.

FIG. 4 is an enlarged schematic cross-sectional drawn representation of a portion of yet another abrasive product 60 which includes a backing similar to that depicted in FIG. 2 with the raised areas and the depressed areas. The one part of the mechanical attachment system depicted in FIG. 4 includes rounded end stems 61 which are described in U.S. Pat. No. 5,505,747 (Chesley et al.), incorporated herein by reference. These stems would be engageble with a second part of the two-part mechanical engagement system which includes similar rounded end stems to that depicted in FIG. 4. FIG. 4 includes an abrasive coating 62 which includes raised portions 63 and depressed portions 64 in a binder coating 65 that includes abrasive particles 66.

Each abrasive composite layer includes components important to surface modification characteristics and the durability of an abrasive article. The components of the abrasive composite layers and other embodiments of the invention are discussed in the following sections of the patent application.

Abrasive Particles

An abrasive article of the present invention typically comprises at least one abrasive composite layer that includes a plurality of abrasive particles dispersed in a binder made by curing precursor polymer subunits. The binder is formed from a binder precursor comprising precursor polymer subunits. The abrasive particles may be uniformly dispersed in a binder or alternatively the abrasive particles may be non-uniformly dispersed therein. It is preferred that the abrasive particles are uniformly dispersed in the binder so that the resulting abrasive article has a more consistent cutting ability.

The average particle size of the abrasive particles can range from about 0.01 to 1500 micrometers, typically between 0.01 and 500 micrometers, and most generally between 1 and 100 micrometers. The size of the abrasive particle is typically specified to be the longest dimension of the abrasive particle. In most cases there will be a range distribution of particle sizes. In some instances it is preferred that the particle size distribution be tightly controlled such that the resulting abrasive article provides a consistent surface finish on the workpiece being abraded.

Examples of conventional hard abrasive particles include fused aluminum oxide, heat-treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, ceria, zirconia, titania, silicates, tin oxide, cubic boron nitride, garnet, fused alumina zirconia, sol gel abrasive particles and the like. Examples of sol gel abrasive particles can be found in U.S. Pat. No. 4,314,827 (Leitheiser et al.); U.S. Pat. No. 4,623,364 (Cottringer et al); U.S. Pat. No. 4,744,802 (Schwabel); U.S. Pat. No. 4,770,671 (Monroe et al.) and U.S. Pat. No. 4,881,951 (Wood et al.), all incorporated hereinafter by reference.

The term abrasive particle, as used herein, also encompasses single abrasive particles bonded together with a polymer to form an abrasive agglomerate. Abrasive agglomerates are further described in U.S. Pat. No. 4,311,489 (Kressner); U.S. Pat. No. 4,652,275 (Bloecher et al.); U.S. Pat. No. 4,799,939 (Bloecher et al.), and U.S. Pat. No. 5,500,273 (Holmes et al.). Alternatively, the abrasive particles may be bonded together by inter particle attractive forces.

The abrasive particle may also have a shape associated with it. Examples of such shapes include rods, triangles, pyramids, cones, solid spheres, hollow spheres and the like. Alternatively, the abrasive particle may be randomly shaped.

Abrasive particles can be coated with materials to provide the particles with desired characteristics. For example, materials applied to the surface of an abrasive particle have been shown to improve the adhesion between the abrasive particle and the polymer. Additionally, a material applied to the surface of an abrasive particle may improve the dispersibility of the abrasive particles in the precursor polymer subunits. Alternatively, surface coatings can alter and improve the cutting characteristics of the resulting abrasive particle. Such surface coatings are described, for example, in U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 4,997,461 (Markhoff-Matheny et al.); U.S. Pat. No. 5,213,591 (Celikkaya et al.); U.S. Pat. No. 5,085,671 (Martin et al.) and U.S. Pat. No. 5,042,991 (Kunz et al.), the disclosures of which are incorporated herein by reference.

Fillers

An abrasive article of this invention may comprise an abrasive coating which further comprises a filler. A filler is a particulate material with an average particle size range between 0.1 to 50 micrometers, typically between 1 to 30 micrometers. Examples of useful fillers for this invention include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, aluminum trihydrate, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron titanium. Other miscellaneous fillers include sulfur, organic sulfur compounds, graphite and metallic sulfides and suspending agents.

An example of a suspending agent is an amorphous silica particle having a surface area less than 150 meters square/gram that is commercially available from DeGussa Corp., Rheinfelden, Germany, under the trade name "OX-50." The addition of the suspending agent can lower the overall viscosity of the abrasive slurry. The use of suspending agents is further described in U.S. Pat. No. 5,368,619 (Culler) incorporated hereinafter by reference.

Binders

The abrasive coating of this invention is formed from a curable abrasive composite layer that comprises a mixture of abrasive particles and precursor polymer subunits. The curable abrasive composite layer preferably comprises organic precursor polymer subunits. The precursor polymer subunits preferably are capable of flowing sufficiently so as to be able to coat a surface. Solidification of the precursor polymer subunits may be achieved by curing (e.g., polymerization and/or cross-linking), by drying (e.g., driving off a liquid) and/or simply by cooling. The precursor polymer subunits may be an organic solvent-borne, a water-borne, or a 100% solids (i.e., a substantially solvent-free) composition. Both thermoplastic and/or thermosetting polymers, or materials, as well as combinations thereof, maybe used as precursor polymer subunits. Upon the curing of the precursor polymer subunits, the curable abrasive composite is converted into the cured abrasive composite. The preferred precursor polymer subunits can be either a condensation curable resin or an addition polymerizable resin. The addition polymerizable resins can be ethylenically unsaturated monomers and/or oligomers. Examples of useable crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

An abrasive composite layer may comprise by weight between about 1 part abrasive particles to 90 parts abrasive particles and 10 parts precursor polymer subunits to 99 parts precursor polymer subunits. Preferably, an abrasive composite layer may comprise about 30 to 85 parts abrasive particles and about 15 to 70 parts precursor polymer subunits. More preferably an abrasive composite layer may comprise about 40 to 70 parts abrasive particles and about 30 to 60 parts precursor polymer subunits.

The precursor polymer subunits are preferably a curable organic material (i.e., a polymer subunit or material capable of polymerizing and/or crosslinking upon exposure to heat and/or other sources of energy, such as electron beam, ultraviolet light, visible light, etc., or with time upon the addition of a chemical catalyst, moisture, or other agent which cause the polymer to cure or polymerize). Precursor polymer subunits examples include amino polymers or aminoplast polymers such as alkylated urea-formaldehyde polymers, melamine-formaldehyde polymers, and alkylated benzoguanamine-formaldehyde polymer, acrylate polymers including acrylates and methacrylates alkyl acrylates, acrylated epoxies, acrylated urethanes, acrylated polyesters, acrylated polyethers, vinyl ethers, acrylated oils, and acrylated silicones, alkyd polymers such as urethane alkyd polymers, polyester polymers, reactive urethane polymers, phenolic polymers such as resole and novolac polymers, phenolic/latex polymers, epoxy polymers such as bisphenol epoxy polymers, isocyanates, isocyanurates, polysiloxane polymers including alkylalkoxysilane polymers, or reactive vinyl polymers. The resulting binder may be in the form of monomers, oligomers, polymers, or combinations thereof.

The aminoplast precursor polymer subunits have at least one pendant alpha, beta-unsaturated carbonyl group per molecule or oligomer. These polymer materials are further described in U.S. Pat. No. 4,903,440 (Larson et al.) and U.S. Pat. No. 5,236,472 (Kirk et al.), both incorporated herein by reference.

Preferred cured abrasive composites are generated from free radical curable precursor polymer subunits. These precursor polymer subunits are capable of polymerizing rapidly upon an exposure to thermal energy and/or radiation energy. One preferred subset of free radical curable precursor polymer subunits include ethylenically unsaturated precursor polymer subunits. Examples of such ethylenically unsaturated precursor polymer subunits include aminoplast monomers or oligomers having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions, and mixtures thereof. The term acrylate includes both acrylates and methacrylates.

Ethylenically unsaturated precursor polymer subunits include both monomeric and polymeric compounds that contain atoms of carbon, hydrogen and oxygen, and optionally, nitrogen and the halogens. Oxygen or nitrogen atoms or both are generally present in the form of ether, ester, urethane, amide, and urea groups. The ethylenically unsaturated monomers may be monofunctional, difunctional, trifunctional, tetrafunctional or even higher functionality, and include both acrylate and methacrylate-based monomers. Suitable ethylenically unsaturated compounds are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, or maleic acid. Representative examples of ethylenically unsaturated monomers include methyl methacrylate, ethyl methacrylate, styrene, divinylbenzene, hydroxyethyl acrylate, hydroxyethyl methacrylate, hydroxypropyl acrylate, hydroxy propyl methacrylate, hydroxybutyl acrylate, hydroxybutyl methacrylate, lauryl acrylate, octyl acrylate, caprolactone acrylate, caprolactone methacrylate, tetrahydrofurfuryl methacrylate, cyclohexyl acrylate, stearyl acrylate, 2-phenoxyethyl acrylate, isooctyl acrylate, isobornyl acrylate, isodecyl acrylate, polyethylene glycol monoacrylate, polypropylene glycol monoacrylate, vinyl toluene, ethylene glycol diacrylate, polyethylene glycol diacrylate, ethylene glycol dimethacrylate, hexanediol diacrylate, triethylene glycol diacrylate, 2-(2-ethoxyethoxy) ethyl acrylate, propoxylated trimethylol propane triacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated materials include monoallyl, polyallyl, or polymethallyl esters and amides of carboxylic acids, such as diallyl phthalate, diallyl adipate, or N,N-diallyladipamide. Still other nitrogen containing ethylenically unsaturated monomers include tris(2-acryloxyethyl)isocyanurate, 1,3,5-tri(2-methyacryloxyethyl)-s-triazine, acrylamide, methylacrylamide, N-methyl-acrylamide, N,N-dimethylacrylamide, N-vinylpyrrolidone, or N-vinylpiperidone.

A preferred precursor polymer subunits contains a blend of two or more acrylate monomers. For example, the precursor polymer subunits may be a blend of trifunctional acrylate and monofunctional acrylate monomers. An example of one precursor polymer subunits is a blend of propoxylated trimethylol propane triacrylate and 2-(2-ethoxyethoxy)ethyl acrylate. The weight ratios of multifunctional acrylate and monofunctional acrylate polymers may range from about 1 part to about 90 parts multifunctional acrylate to about 10 parts to about 99 parts monofunctional acrylate.

It is also feasible to formulate a precursor polymer subunits from a mixture of an acrylate and an epoxy polymer, e.g., as described in U.S. Pat. No. 4,751,138 (Tumey et al.), incorporated herein by reference.

Other precursor polymer subunits include isocyanurate derivatives having at least one pendant acrylate group and isocyanate derivatives having at least one pendant acrylate group are further described in U.S. Pat. No. 4,652,274 (Boettcher et al.), incorporated herein by reference. The preferred isocyanurate material is a triacrylate of tris (hydroxyethyl)isocyanurate.

Still other precursor polymer subunits include diacrylate urethane esters as well as polyacrylate or polymethacrylate urethane esters of hydroxy terminated isocyanate extended polyesters or polyethers. Examples of commercially available acrylated urethanes include those under the tradename "UVITHANE 782," available from Morton Chemical, Moss Point, Miss.; "CMD 6600," "CMD 8400," and "CMD 8805," available from UCB Radcure Specialties, Smyrna, Ga.; "PHOTOMER" resins (e.g., PHOTOMER 6010) from Henkel Corp., Hoboken, N.J.; "EBECRYL 220" (hexafunctional aromatic urethane acrylate), "EBECRYL 284" (aliphatic urethane diacrylate of 1200 diluted with 1,6-hexanediol diacrylate), "EBECRYL 4827" (aromatic urethane diacrylate), "EBECRYL 4830" (aliphatic urethane diacrylate diluted with tetraethylene glycol diacrylate), "EBECRYL 6602" (trifunctional aromatic urethane acrylate diluted with trimethylolpropane ethoxy triacrylate), "EBECRYL 840" (aliphatic urethane diacrylate), and "EBECRYL 8402" (aliphatic urethane diacrylate) from UCB Radcure Specialties; and "SARTOMER" resins (e.g., "SARTOMER" 9635, 9645, 9655, 963-B80, 966-A80, CN980M50, etc.) from Sartomer Co., Exton, Pa.

Yet other precursor polymer subunits include diacrylate epoxy esters as well as polyacrylate or poly methacrylate epoxy ester such as the diacrylate esters of bisphenol A epoxy polymer. Examples of commercially available acrylated epoxies include those under the tradename "CMD 3500," "CMD 3600," and "CMD 3700," available from UCB Radcure Specialties.

Other precursor polymer subunits may also be acrylated polyester polymers. Acrylated polyesters are the reaction products of acrylic acid with a dibasic acid/aliphatic diol-based polyester. Examples of commercially available acrylated polyesters include those known by the trade designations "PHOTOMER 5007" (hexafunctional acrylate), and "PHOTOMER 5018" (tetrafunctional tetracrylate) from Henkel Corp.; and "EBECRYL 80" (tetrafunctional modified polyester acrylate), "EBECRYL 450" (fatty acid modified polyester hexaacrylate) and "EBECRYL 830" (hexafunctional polyester acrylate) from UCB Radcure Specialties.

Another preferred precursor polymer subunits is a blend of ethylenically unsaturated oligomer and monomers. For example the precursor polymer subunits may comprise a blend of an acrylate functional urethane oligomer and one or more monofunctional acrylate monomers. This acrylate monomer may be a pentafunctional acrylate, tetrafunctional acrylate, trifunctional acrylate, difunctional acrylate, monofunctional acrylate polymer, or combinations thereof.

The precursor polymer subunits may also be an acrylate dispersion like that described in U.S. Pat. No. 5,378,252 (Follensbee), incorporated herein by reference.

In addition to thermosetting polymers, thermoplastic binders may also be used. Examples of suitable thermoplastic polymers include polyamides, polyethylene, polypropylene, polyesters, polyurethanes, polyetherimide, polysulfone, polystyrene, acrylonitrile-butadiene-styrene block copolymer, styrene-butadiene-styrene block copolymers, styrene-isoprene-styrene block copolymers, acetal polymers, polyvinyl chloride and combinations thereof.

Water-soluble precursor polymer subunits optionally blended with a thermosetting resin may be used. Examples of water-soluble precursor polymer subunits include polyvinyl alcohol, hide glue, or water-soluble cellulose ethers such as hydroxypropylmethyl cellulose, methyl cellulose or hydroxyethylmethyl cellulose. These binders are reported in U.S. Pat. No. 4,255,164 (Butkze et al.), incorporated herein by reference.

In the case of precursor polymer subunits containing ethylenically unsaturated monomers and oligomers, polymerization initiators may be used. Examples include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, or mixtures thereof. Examples of suitable commercially available, ultraviolet-activated photoinitiators have tradenames such as "IRGACURE 651," "IRGACURE 184," and "DAROCUR 1173" commercially available from Ciba Specialty Chemicals, Tarrytown, N.Y. Another visible light-activated photoinitiator has the trade name "IRGACURE 369" commercially available from Ciba Geigy Company. Examples of suitable visible light-activated initiators are reported in U.S. Pat. No. 4,735,632 (Oxman et al.) and U.S. Pat No. 5,674,122 (Krech, et al.).

A suitable initiator system may include a photosensitizer. Representative photosensitizers may have carbonyl groups or tertiary amino groups or mixtures thereof. Preferred photosensitizers having carbonyl groups are benzophenone, acetophenone, benzil, benzaldehyde, o-chlorobenzaldehyde, xanthone, thioxanthone, 9,10-anthraquinone, or other aromatic ketones. Preferred photosensitizers having tertiary amines are methyldiethanolamine, ethyldiethanolamine, triethanolamine, phenylmethyl-ethanolamine, or dimethylaminoethylbenzoate. Commercially available photosensitizers include "QUANTICURE ITX," "QUANTICURE QTX," "QUANTICURE PTX," "QUANTICURE EPD" from Biddle Sawyer Corp., New York, N.Y.

In general, the amount of photosensitizer or photoinitiator system may vary from about 0.01 to 10% by weight, more preferably from 0.25 to 4.0% by weight of the components of the precursor polymer subunits.

Additionally, it is preferred to disperse (preferably uniformly) the initiator in the precursor polymer subunits before addition of any particulate material, such as the abrasive particles and/or filler particles.

In general, it is preferred that the precursor polymer subunits be exposed to radiation energy, preferably ultraviolet light or visible light, to cure or polymerize the precursor polymer subunits. In some instances, certain abrasive particles and/or certain additives will absorb ultraviolet and visible light, which may hinder proper cure of the precursor polymer subunits. This occurs, for example, with ceria abrasive particles. The use of phosphate containing photoinitiators, in particular acylphosphine oxide containing photoinitiators, may minimize this problem. An example of such an acylphosphate oxide is 2,4,6-trimethylbenzoyldiphenylphosphine oxide, which is commercially available from BASF Corporation, Ludwigshafen, Germany, under the trade designation "LR8893." Other examples of commercially available acylphosphine oxides include "DAROCUR 4263" and "DAROCUR 4265" commercially available from Ciba Specialty Chemicals.

Cationic initiators may be used to initiate polymerization when the binder is based upon an epoxy or vinyl ether. Examples of cationic initiators include salts of onium cations, such as arylsulfonium salts, as well as organometallic salts such as ion arene systems. Other examples are reported in U.S. Pat. No. 4,751,138 (Tumey et al.); U.S. Pat. No. 5,256,170 (Harmer et al.); U.S. Pat. No. 4,985,340 (Palazotto); and U.S. Pat. No. 4,950,696, all incorporated herein by reference.

Dual-cure and hybrid-cure photoinitiator systems may also be used. In dual-cure photoiniator systems, curing or polymerization occurs in two separate stages, via either the same or different reaction mechanisms. In hybrid-cure photoinitiator systems, two curing mechanisms occur at the same time upon exposure to ultraviolet/visible or electron-beam radiation.

Backing

A variety of backing materials are suitable for the abrasive article of the present invention, including both flexible backings and backings that are more rigid. Examples of typical flexible abrasive backings include polymeric film, primed polymeric film, cloth, paper, vulcanized fiber, non-wovens and treated versions thereof and combinations thereof. Non-polymeric backings may be used if the raised areas and the one part of the mechanical engaging system are applied to its major surfaces by employing molten polymeric material to provide each of these features. That is, the non-polymeric backing would be conducted through the process and the cavities providing the raised areas and hooks or stems would be filled with molten polymers. The thickness of a backing measured from the highest point of the raised area on the first major surface to the second major surface generally ranges between about 20 to 5000 micrometers and preferably between 50 to 2500 micrometers.

Alternatively, the backing may be fabricated from a porous material such as a foam, including open and closed cell foam.

Another example of a suitable backing is described in U.S. Pat. No. 5,417,726 (Stout et al.) incorporated herein by reference. The backing may also consist of two or more backings laminated together, as well as reinforcing fibers engulfed in a polymeric material as disclosed in U.S. Pat. No. 5,573,619 (Benedict et al.).

The backing may be a sheet like structure that was previously considered in the art to be an attachment system. For example the backing may be a loop fabric, having engaging loops on the opposite second major surface and a relatively smooth first major surface. The shaped structures are adhered to the first major surface. Examples of loop fabrics include stitched loop, Tricot loops and the like. Additional information on suitable loop fabrics may be found in U.S. Pat. No. 4,609,581 (Ott) and U.S. Pat. No. 5,254,194 (Ott) both incorporated herein after by reference. Alternatively the backing may be a sheet like structure having engaging hooks protruding from the opposite second major surface and a relatively smooth first major surface. The shaped structures are adhered to the first major surface. Examples of such sheet like structures with engaging hooks may be found in U.S. Pat. No. 5,505,747 (Chesley), U.S. Pat. No. 5,667,540 (Chesley), U.S. Pat. No. 5,672,186 (Chesley) and U.S. Pat. No. 6,197,076 (Braunschweig) all incorporated herein after by reference. During use, the engaging loops or hooks are designed to interconnect with the appropriate hooks or loops of a support structure such as a back up pad.

Shaped Structures

The shaped structures may be fabricated out of any suitable material, including: nonwovens, foam (open and closed cell foam), polymeric film, polymeric material (both thermosetting and thermoplastic polymers). Examples of thermosetting polymers include: phenolic, epoxy, acrylate, urethane, urea-formaldehyde, melamine-formaldehyde and the like. Examples of thermoplastic polymers include: polyurethane, nylon, polypropylene, polyethylene, polyester, acyrnonitrile butadiene stryene, stryene, and the like.

Heights of backing raised portions may range from about 0.05 millimeters to about 20 millimeters, typically about 0.1 to about 10 millimeters and preferably about 0.25 to about 5 millimeters. Heights of abrasive coating raised portions range from about 5 micrometers ($\mu$m) to about 1000 $\mu$m, typically about 25 $\mu$m to about 500 $\mu$m and preferably about 25 $\mu$m to about 250 $\mu$m.

Ratio of backing height raised portions to abrasive coating raised portions may be in the range of about 1:1 to 1000:1, typically about 2:1 to 500:1 and preferably about 5:1 to 100:1.

The shaped structures may be bonded to the backing or alternatively the shaped structures may be unitary with the backing.

Shaped Backing

There are numerous means to make the backing with the shaped structures. In one aspect, the shaped structures may be laminated or adhered to the first major surface of the backing. Any suitable lamination technique or adhesive may be employed. In another aspect, the shaped structures are formed on the first major surface of the backing. There are numerous methods to achieve this.

Figure 8:
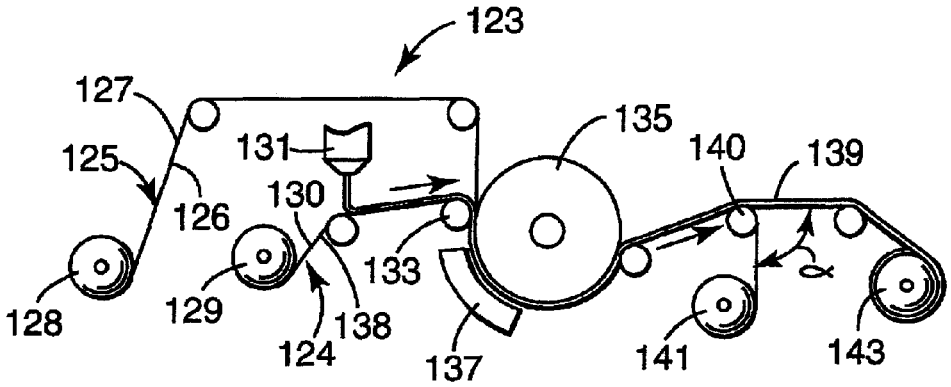
FIG. 8 is a schematic representation of one process for making an abrasive article according to the present invention.

In the first method, the shaped structure is formed by a continuous molding process. In this process, it is generally preferred that the shaped structures be made from an acrylate and/or epoxy resin that is capable of being crosslinked into an acrylate and/or epoxy polymer. Additional details on acrylate resins and epoxy resin may be found in the binder section of this patent application. FIG. 8 illustrates an apparatus 123 for applying a shaped coating to the first major surface of the backing. A production tool 124 is in the form of a belt having a cavity-bearing contacting surface 130, an opposite backing surface 138 and appropriately sized cavities within contacting surface 130. Backing 125 having a first major surface 126 and a second major surface 127 is unwound from roll 128. At the same time backing 125 is unwound from roll 128, the production tool 124 is unwound from roll 129. The contacting surface 130 of production tool 124 is coated with a binder precursor for forming the shaped structures at coating station 131. The binder precursor can be heated to lower the viscosity thereof prior to the coating step. The coating station 131 can comprise any conventional coating means, such as knife coater, drop die coater, curtain coater, vacuum die coater, or an extrusion die coater. After the contacting surface 130 of production tool 124 is coated, the backing 125 and the production tool 124 are brought together such that the mixture wets the first major surface 126 of the backing 125. In FIG. 8, the mixture is forced into contact with the backing 125 by means of a contact nip roll 133, which also forces the production tool/binder precursor/backing construction against a support drum 135. Next, a sufficient dose of radiation energy is transmitted by a source of radiation energy 137 through the back surface 138 of production tool 124 and into the mixture to at least partially cure the binder precursor, thereby forming a shaped, handleable structure 139. The production tool 124 is then separated from the shaped, handleable structure 139. Separation of the production tool 124 from the shaped handleable structure 139 occurs at roller 140. The angle $\alpha$ between the shaped, handleable structure 139 and the production tool 124 immediately after passing over roller 140 is preferably steep, e.g., in excess of 30°, in order to bring about clean separation of the shaped, handleable structure 139 from the production tool 124. The production tool 124 is rewound as roll 141 so that it can be reused. Shaped, handleable structure 139 is wound as roll 143. If the binder precursor has not been fully cured, it can then be fully cured by exposure to an additional energy source, such as a source of thermal energy or an additional source of radiation energy, to form the shaped backing. Alternatively, full cure may eventually result without the use of an additional energy source to form the coated abrasive article. As used herein, the phrase "full cure" and the like means that the binder precursor is sufficiently cured so that the resulting product will function as a backing for a coated abrasive article.

Typically the production tool is used to provide a polymeric composite layer with an array of either precisely or irregularly shaped structures. The production tool has a surface containing a plurality of cavities. These cavities are essentially the inverse shape of the polymeric structures and are responsible for generating the shape and placement of the polymeric structures. These cavities may have any geometric shape that is the inverse shape to the geometric shapes suitable for the shaped structures onto which the abrasive layer is coated. Preferably, the shape of the cavities is selected such that the surface area of the shaped structure decreases away from the backing. The production tool can be a belt, a sheet, a continuous sheet or web, a coating roll such as a rotogravure roll, a sleeve mounted on a coating roll, or die. The same equipment is used to apply a shaped abrasive coating to the backing. Additional details on production tools may be found in the section for "Making Abrasive Coating."

In another method of making a shaped backing, the curable resin can be coated onto the surface of a rotogravure roll. The backing comes into contact with the rotogravure roll and the curable resin wets the backing. The rotogravure roll then imparts a pattern or texture into the curable resin. Next, the resin/backing combination is removed from the rotogravure roll and the resulting construction is exposed to conditions to cure the precursor polymer subunits such that shaped polymer features are formed. A variation of this process is to coat the curable resin onto the backing and bring the backing into contact with the rotogravure roll.

The rotogravure roll may impart desired patterns such as a hexagonal array, truncated ridges, lattices, spheres, truncated pyramids, cubes, blocks, or rods. The rotogravure roll may also impart a pattern such that there is a land area between adjacent polymeric features. Alternatively, the rotogravure roll can impart a pattern such that the backing is exposed between adjacent polymeric shapes. Similarly, the rotogravure roll can impart a pattern such that there is a mixture of polymeric shapes.

In still another method is to spray or coat the curable resin layer through a screen to generate a pattern in the curable resin layer. Then the precursor polymer subunits are cured to form the polymeric structures. The screen can impart any desired pattern such as a hexagonal array, truncated ridges, lattices, spheres, pyramids, truncated pyramids, cubes, blocks, or rods. The screen may also impart a pattern such that there is a land area between adjacent polymeric structures. Alternatively, the screen may impart a pattern such that the backing is exposed between adjacent polymeric structures. Similarly, the screen may impart a pattern such that there is a mixture of polymeric shapes.

Another method of making a shaped backing is to laminate a textured, shaped or embossed layer onto the first major surface of the backing. The resulting shaped laminate can then be used as the backing onto which an abrasive layer is coated onto the textured, shaped or embossed layer. This textured, shaped or embossed layer can include, for example, scrims or screens.

Yet another alternative method for making a shaped backing is to pattern-coat a curable resin onto a generally planar backing, wherein the resin contains a component that can subsequently be expanded such that the dimensions of the pattern-coated resin features increase after expansion. This expansion preferably takes place before curing of the resin, but can also take place after curing. Examples of components that can be expanded upon changes in process conditions include expandable microspheres, such as available under the MICROPEARL tradename from Pierce-Stevens Corp, Buffalo, N.Y. A modification to this method is that the polymer microspheres are expanded prior to adding to the curable resin. The curable resin is pattern-coated into structures that are of sufficient height, and subsequently cured, yielding a shaped backing with features comprised of polymeric foam.

A backing consisting of shaped structures can also be formed by the continuous coating of a layer of curable resin wherein the resin contains a component that can subsequently be expanded in a pattern by local irradiation with specific wavelength range of electromagnetic radiation, e.g. infrared. Preferably, the curable resin layer is cured subsequent to the patterned expansion of the expandable component.

In yet another method, the backing is embossed to create the shaped structures. For example, thermoplastic films or foams such as nylon, propylene, polyester, polyethylene and the like, may be thermally embossed. The embossing tool has essentially the inverse of the desired shape and dimensions of the shaped structures.

The particular type and construction of the backing and/or shaped structures will depend upon many factors and mainly upon the desired properties of the final abrasive article for the intended abrasive application. For example where a flexible abrasive article is desired, a foam backing and foam structures may be desirable. Alternatively where high cut rates are desired, a stiffer backing may be preferred. One skilled in the art will be able to formulate a backing and shaped structures that exhibit the appropriate properties.

An Abrasive Composite Layer

An abrasive composite layer of this invention typically comprises a plurality of abrasive particles fixed and dispersed in precursor polymer subunits, but may include other additives such as coupling agents, fillers, expanding agents, fibers, antistatic agents, initiators, suspending agents, photosensitizers, lubricants, wetting agents, surfactants, pigments, dyes, UV stabilizers and suspending agents. The amounts of these additives are selected to provide the properties desired.

The abrasive composite may optionally include a plasticizer. In general, the addition of the plasticizer will increase the erodibility of the abrasive composite and soften the overall binder composition. In some instances, the plasticizer will act as a diluent for the precursor polymer subunits. The plasticizer is preferably compatible with the precursor polymer subunits to minimize phase separation. Examples of suitable plasticizers include polyethylene glycol, polyvinyl chloride, dibutyl phthalate, alkyl benzyl phthalate, polyvinyl acetate, polyvinyl alcohol, cellulose esters, silicone oils, adipate and sebacate esters, polyols, polyols derivatives, t-butylphenyl diphenyl phosphate, tricresyl phosphate, castor oil, or combinations thereof. Phthalate derivatives are one type of preferred plasticizers.

The abrasive particle, or abrasive coating, may further comprise surface modification additives include wetting agents (also sometimes referred to as surfactants) and coupling agents. A coupling agent can provide an association bridge between the precursor polymer subunits and the abrasive particles. Additionally, the coupling agent can provide an association bridge between the binder and the filler particles. Examples of coupling agents include silanes, titanates, and zircoaluminates.

In addition, water and/or organic solvent may be incorporated into the abrasive composite. The amount of water and/or organic solvent is selected to achieve the desired coating viscosity of precursor polymer subunits and abrasive particles. In general, the water and/or organic solvent should be compatible with the precursor polymer subunits. The water and/or solvent may be removed following polymerization of the precursor, or it may remain with the abrasive composite. Suitable water soluble and/or water sensitive additives include polyvinyl alcohol, polyvinyl acetate, or cellulosic based particles.

Examples of ethylenically unsaturated diluents or monomers can be found in U.S. Pat. No. 5,236,472 (Kirk et al.), incorporated herein by reference. In some instances these ethylenically unsaturated diluents are useful because they tend to be compatible with water. Additional reactive diluents are disclosed in U.S. Pat. No. 5,178,646 (Barber et al.), incorporated herein by reference.

Abrasive Composite Structure Configuration

An abrasive article of this invention contains an abrasive coating with at least one abrasive composite layer that includes plurality of shaped, preferably precisely shaped, abrasive composite structures. The term "shaped" in combination with the term "abrasive composite structure" refers to both "precisely shaped" and "irregularly shaped" abrasive composite structures. An abrasive article of this invention may contain a plurality of such shaped abrasive composite structures in a predetermined array on a backing. An abrasive composite structure can be formed, for example, by curing the precursor polymer subunits while being borne on the backing and in the cavities of the production tool.

The shape of the abrasive composites structures may be any of a variety of geometric configurations. Typically the base of the shape in contact with the backing has a larger surface area than the distal end of the composite structure. The shape of the abrasive composite structure may be selected from among a number of geometric solids such as a cubic, cylindrical, prismatic, parallelepiped, pyramidal, truncated pyramidal, conical, hemispherical, truncated conical, or posts having any cross section. Generally, shaped composites having a pyramidal structure have three, four, five or six sides, not including the base. The cross-sectional shape of the abrasive composite structure at the base may differ from the cross-sectional shape at the distal end. The transition between these shapes may be smooth and continuous or may occur in discrete steps. The abrasive composite structures may also have a mixture of different shapes. The abrasive composite structures may be arranged in rows, spiral, helix, or lattice fashion, or may be randomly placed.

The sides forming the abrasive composite structures may be perpendicular relative to the backing, tilted relative to the backing or tapered with diminishing width toward the distal end. An abrasive composite structure with a cross section that is larger at the distal end than at the back may also be used, although fabrication may be more difficult.

The height of each abrasive composite structure is preferably the same, but it is possible to have composite structures of varying heights in a single fixed abrasive article. The height of the composite structures generally may be less than about 2000 micrometers, and more particularly in the range of about 25 to 1000 micrometers. The diameter or cross sectional width of the abrasive composite structure can range from about 5 to 500 micrometers, and typically between about 10 to 250 micrometers.

The base of the abrasive composite structures may abut one another or, alternatively, the bases of adjacent abrasive composites may be separated from one another by some specified distance.

The linear spacing of the abrasive composite structures may range from about 1 to 24,000 composites/cm$^2$ and preferably at least about 50 to 15,000 abrasive composite structures/cm$^2$. The linear spacing may be varied such that the concentration of composite structures is greater in one location than in another. The area spacing of composite structures ranges from about 1 abrasive composite structure per linear cm to about 100 abrasive composite structures per linear cm and preferably between about 5 abrasive composite structures per linear cm to about 80 abrasive composites per linear cm.

The percentage bearing area may range from about 5 to about 95%, typically about 10% to about 80%, preferably about 25% to about 75% and more preferably about 30% to about 70%.

The shaped abrasive composite structures are preferably set out on a backing, or a previously cured abrasive composite layer, in a predetermined pattern. Generally, the predetermined pattern of the abrasive composite structures will correspond to the pattern of the cavities on the production tool. The pattern is thus reproducible from article to article.

In one embodiment, an abrasive article of the present invention may contain abrasive composite structures in an array. With respect to a single abrasive composite layer, a regular array refers to aligned rows and columns of abrasive composite structures. In another embodiment, the abrasive composite structures may be set out in a "random" array or pattern. By this it is meant that the abrasive composite structures are not aligned in specific rows and columns. For example, the abrasive composite structures may be set out in a manner as described in U.S. Pat. No. 5,681,217 (Hoopman et al.). It is understood, however, that this "random" array is a predetermined pattern in that the location of the composites is predetermined and corresponds to the location of the cavities in the production tool used to make the abrasive article. The term "array" refers to both "random" and "regular" arrays.

Production Tool

Figure 5:
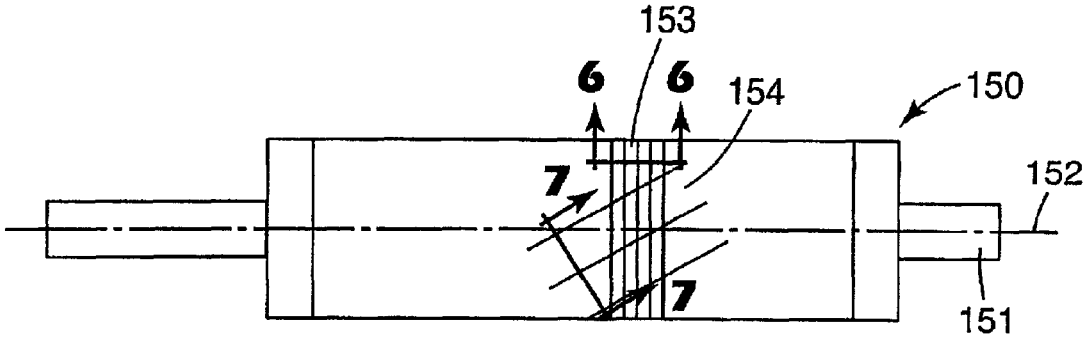
FIG. 5 is a top plane view of a roller for making a production tool useful for making the shaped abrasive layer of the abrasive product depicted in FIG. 4.

FIG. 5 shows a roller that was used to make production tool 124 as depicted in FIG. 8. The following specific embodiment of roller 150 was used to make production tool 124 which was then used to make the abrasive composite structure of the present invention. Roller 150 has a shaft 151 and an axis of rotation 152. In this case the patterned surface includes a first set 153 of adjacent circumferential grooves around the roller and a second set 154 of equally spaced grooves deployed at an angle of 30° with respect to the axis of rotation 152.

Figure 6:
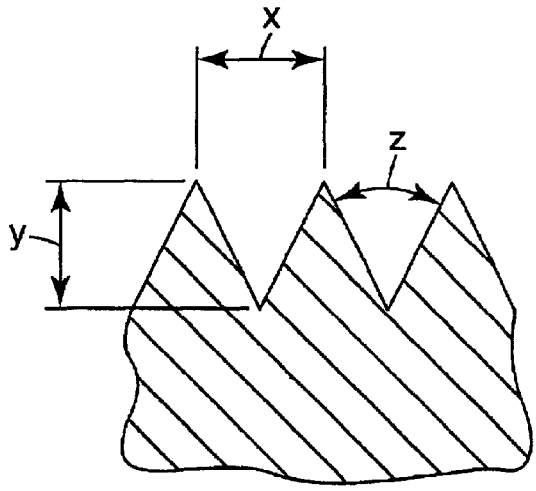
FIG. 6 is an enlarged sectional view of one segment of the roll depicted in FIG. 5 taken at line 6—6 to show surface detail.

FIG. 6 shows an enlarged cross sectional view of a segment of the patterned surface of roller 150 taken at line 6—6 in FIG. 5 perpendicular to the grooves in set 153. FIG. 6 shows the patterned surface has peaks spaced by distance x which is 54.8 μm apart peak to peak and a peak height, y, from valley to peak of 55 μm, with an angle z which is 53°.

Figure 7:
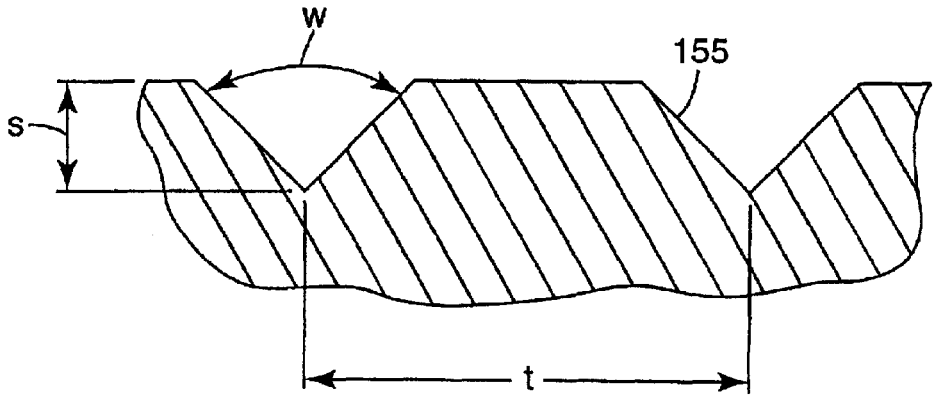
FIG. 7 is an enlarged sectional view of another segment of the patterned surface of the roll depicted in FIG. 5, taken at line 7—7.

FIG. 7 shows an enlarged cross sectional view of a segment of the patterned surface of roller 150 taken at line 7—7 in FIG. 5 perpendicular to the grooves in set 154. FIG. 7 shows grooves 155 having an angle w which is a 99.5° angle between adjacent peak slopes and valleys separated by a distance t which is 250 μm and a valley depth s which is 55 μm.

Figure 9:
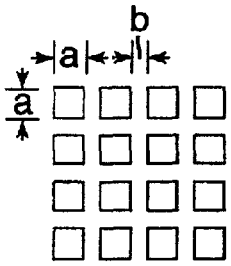
FIG. 9 is an enlarged drawn plane view representation of a pattern used to make tooling for Examples 2 and 3.

Roller 150 may also be used to make a production tool for forming the shaped structures in abrasive layer 62, depicted in FIG. 4, according to the method described in U.S. Pat. No. 5,435,816 (Spurgeon et al.), which is incorporated herein by reference. FIG. 9 shows a plan view of exemplary square shaped structures having post and bearing areas defined by the dimensions a and b.

A production tool is used to provide an abrasive composite layer with an array of either precisely or irregularly shaped abrasive composite structures. A production tool has a surface containing a plurality of cavities. These cavities are essentially the inverse shape of the abrasive composite structures and are responsible for generating the shape and placement of the abrasive composite structures. These cavities may have any geometric shape that is the inverse shape to the geometric shapes suitable for the abrasive composites. Preferably, the shape of the cavities is selected such that the surface area of the abrasive composite structure decreases away from the backing.

The production tool can be a belt, a sheet, a continuous sheet or web, a coating roll such as a rotogravure roll, a sleeve mounted on a coating roll, or die. The production tool can be composed of metal, (e.g., nickel), metal alloys, or plastic. The metal production tool can be fabricated by any conventional technique such as photolithography, knurling, engraving, hobbing, electroforming, diamond turning, and the like. Preferred methods of making metal master tools are described in U.S. Pat. No. 5,975,987 (Hoopman et al.).

A thermoplastic tool can be replicated off a metal master tool. The master tool will have the inverse pattern desired for the production tool. The master tool is preferably made out of metal, e.g., a nickel-plated metal such as aluminum, copper or bronze. A thermoplastic sheet material optionally can be heated along with the master tool such that the thermoplastic material is embossed with the master tool pattern by pressing the two together. The thermoplastic material can also be extruded or cast onto the master tool and then pressed. The thermoplastic material is cooled to a nonflowable state and then separated from the master tool to produce a production tool. The production tool may also contain a release coating to permit easier release of the abrasive article from the production tool. Examples of such release coatings include silicones and fluorochemicals.

Suitable thermoplastic production tools are reported in U.S. Pat. No. 5,435,816 (Spurgeon et al.), incorporated herein by reference. Examples of thermoplastic materials useful to form the production tool include polyesters, polypropylene, polyethylene, polyamides, polyurethanes, polycarbonates, or combinations thereof. It is preferred that the thermoplastic production tool contain additives such as anti-oxidants and/or UV stabilizers. These additives may extend the useful life of the production tool.

Method for Making an Abrasive Article

There are a number of methods to make the abrasive article of this invention. In one aspect the abrasive coating comprises a plurality of precisely shaped abrasive composites. In another aspect the abrasive coating comprises non-precisely shaped abrasive composites, sometimes referred to as irregularly shaped abrasive composites. A preferred method for making an abrasive article with one abrasive composite layer having precisely shaped abrasive composite structures is described in U.S. Pat. No. 5,152,917 (Pieper et al) and U.S. Pat. No. 5,435,816 (Spurgeon et al.), both incorporated herein by reference. Other descriptions of suitable methods are reported in U.S. Pat. No. 5,454,844 (Hibbard et al.); U.S. Pat. No. 5,437,754 (Calhoun); and U.S. Pat. No. 5,304,223 (Pieper et al.), all incorporated herein by reference.

A suitable method for preparing an abrasive composite layer having a plurality of shaped abrasive composite structures includes preparing a curable abrasive composite layer comprising abrasive particles, precursor polymer subunits and optional additives; providing a production tool having a front surface; introducing the curable abrasive composite layer into the cavities of a production tool having a plurality of cavities; introducing a backing or previously cured abrasive composite layer of an abrasive article to the curable abrasive composite layer; and curing the curable abrasive composite layer before the article departs from the cavities of the production tool to form a cured abrasive composite layer comprising abrasive composite structures. The curable abrasive composite is applied to the production tool so that the thickness of the curable abrasive composite layer is less than or equal to its practical thickness limit.

An abrasive composite layer that is substantially free of a plurality of precisely shaped abrasive composite structures is made by placing a curable abrasive composite layer on a backing, or previously cured abrasive composite layers, independently of a production tool, and curing the abrasive composite layer to form a cured abrasive composite layer. The curable abrasive composite layer is applied to a surface so that the thickness of the abrasive composite layer is less than or equal to its practical thickness limit. Additional abrasive composite layers may be added to an abrasive article by repeating the above steps.

The curable abrasive composite layer is made by combining together by any suitable mixing technique the precursor polymer subunits, the abrasive particles and the optional additives. Examples of mixing techniques include low shear and high shear mixing, with high shear mixing being preferred. Ultrasonic energy may also be utilized in combination with the mixing step to lower the curable abrasive composite viscosity (the viscosity being important in the manufacture of the an abrasive article) and/or affect the rheology of the resulting curable abrasive composite layer. Alternatively, the curable abrasive composite layer may be heated in the range of 30 to 70° C., microfluidized or ball milled in order to mix the curable abrasive composite.

Typically, the abrasive particles are gradually added into the precursor polymer subunits. It is preferred that the curable abrasive composite layer be a homogeneous mixture of precursor polymer subunits, abrasive particles and optional additives. If necessary, water and/or solvent is added to lower the viscosity. The formation of air bubbles may be minimized by pulling a vacuum either during or after the mixing step.

The coating station can be any conventional coating means such as drop die coater, knife coater, curtain coater, vacuum die coater or a die coater. A preferred coating technique is a vacuum fluid bearing die reported in U.S. Pat. Nos. 3,594,865; 4,959,265 (Wood); and U.S. Pat. No. 5,077,870 (Melbye, et al.), which are incorporated herein by reference. During coating, the formation of air bubbles is preferably minimized.

In another variation, both the shaped portion of the shaped, flexible backing and the shaped abrasive composite may be molded from a single tooling using one or two sequential coating operations. Alternatively, the production tool may be filled in two sequential coating steps, the first of which only partially fills the tool with the non-abrasive composition and the second of which fills the remainder of the tool with an abrasive-filled resin or slurry. As with the shape of the shaped features of the backing, and with the non-abrasive composition of the first coating, this second abrasive-filled resin or slurry may be tailored to optimize the performance of the resulting abrasive article. In a two-step coating operation, the first coating operation is preferably accomplished by means of the aforementioned vacuum fluid bearing die method or slide die coating method reported in U.S. Pat. No. 5,741,549 (Maier, et al.).

After the production tool is coated, the backing, or previously cured abrasive composite layer of an abrasive article, and the next layer of curable abrasive composite is brought into contact by any means such that the next layer of curable abrasive composite wets a surface of the shaped backing. The curable abrasive composite layer is brought into contact with the shaped backing by contacting the nip roll which forces the resulting construction together. The nip roll may be made from any material; however, the nip roll is preferably made from a structural material such as metal, metal alloys, rubber or ceramics. The hardness of the nip roll may vary from about 30 to 120 durometer, preferably about 60 to 100 durometer, and more preferably about 90 durometer.

Next, energy is transmitted into the curable abrasive composite layer by an energy source to at least partially cure the precursor polymer subunits. The selection of the energy source will depend in part upon the chemistry of the precursor polymer subunits, the type of production tool as well as other processing conditions. The energy source should not appreciably degrade the production tool or backing. Partial cure of the precursor polymer subunits means that the precursor polymer subunits is polymerized to such a state that the curable abrasive composite layer does not flow when inverted in the production tool. If needed, the precursor polymer subunits may be fully cured after it is removed from the production tool using conventional energy sources.

After at least partial cure of the precursor polymer subunits, the production tool and abrasive article are separated. If the precursor polymer subunits are not essentially fully cured, the precursor polymer subunits can then be essentially fully cured by either time and/or exposure to an energy source. Finally, the production tool is rewound on a mandrel so that the production tool can be reused again and the fixed abrasive article is wound on another mandrel.

In another variation of this first method, the curable abrasive composite layer is coated onto the shaped backing and not into the cavities of the production tool. The curable abrasive composite layer coated backing is then brought into contact with the production tool such that the slurry flows into the cavities of the production tool. The remaining steps to make the abrasive article are the same as detailed above.

It is preferred that the precursor polymer subunits are cured by radiation energy. The radiation energy may be transmitted through the backing or through the production tool. The shaped backing or production tool should not appreciably absorb the radiation energy. Additionally, the radiation energy source should not appreciably degrade the backing or production tool. For instance, ultraviolet light can be transmitted through a polyester backing. Alternatively, if the production tool is made from certain thermoplastic materials, such as polyethylene, polypropylene, polyester, polycarbonate, poly(ether sulfone), poly(methyl methacrylate), polyurethanes, polyvinylchloride, or combinations thereof, ultraviolet or visible light may be transmitted through the production tool and into the slurry. For thermoplastic based production tools, the operating conditions for making the fixed abrasive article should be set such that excessive heat is not generated. If excessive heat is generated, this may distort or melt the thermoplastic tooling.

The energy source may be a source of thermal energy or radiation energy, such as electron beam, ultraviolet light, or visible light. The amount of energy required depends on the chemical nature of the reactive groups in the precursor polymer subunits, as well as upon the thickness and density of the binder slurry. For thermal energy, an oven temperature of from about 50° C. to about 250° C. effect on shaped structure and/or backing, and a duration of from about 15 minutes to about 16 hours are generally sufficient. Electron beam radiation or ionizing radiation may be used at an energy level of about 0.1 to about 10 Mrad, preferably at an energy level of about 1 to about 10 Mrad. Ultraviolet radiation includes radiation having a wavelength within a range of about 200 to about 400 nanometers, preferably within a range of about 250 to 400 nanometers. Visible radiation includes radiation having a wavelength within a range of about 400 to about 800 nanometers, preferably in a range of about 400 to about 550 nanometers.

The resulting cured abrasive composite layer will have the inverse pattern of the production tool. By at least partially curing or curing on the production tool, the abrasive composite layer has a precise and predetermined pattern.

There are many methods for making abrasive composites having irregularly shaped abrasive composites. While being irregularly shaped, these abrasive composites may nonetheless be set out in a predetermined pattern, in that the location of the composites is predetermined. In one method, curable abrasive composite is coated so that the thickness of the abrasive composite layer is within the practical thickness limits of the composite, into cavities of a production tool to generate the abrasive composites. The production tool may be the same production tool as described above in the case of precisely shaped composites. However, the curable abrasive composite layer is removed from the production tool before the precursor polymer subunits is cured sufficiently for it to substantially retain its shape upon removal from the production tool. Subsequent to this, the precursor polymer subunits are cured. Since the precursor polymer subunits are not cured while in the cavities of the production tool, this results in the curable abrasive composite layer flowing and distorting the abrasive composite shape.

In another method of making irregularly shaped composites, the curable abrasive composite can be coated onto the surface of a rotogravure roll. The shaped backing comes into contact with the rotogravure roll and the curable abrasive composite wets the backing. The rotogravure roll then imparts a pattern or texture into the curable abrasive composite. Next, the slurry/backing combination is removed from the rotogravure roll and the resulting construction is exposed to conditions to cure the precursor polymer subunits such that an abrasive composite is formed. A variation of this process is to coat the curable abrasive composite onto the backing and bring the backing into contact with the rotogravure roll.

The rotogravure roll may impart desired patterns such as a hexagonal array, ridges, lattices, spheres, pyramids, truncated pyramids, cones, cubes, blocks, or rods. The rotogravure roll may also impart a pattern such that there is a land area between adjacent abrasive composites. This land area can comprise a mixture of abrasive particles and binder. Alternatively, the rotogravure roll can impart a pattern such that the backing is exposed between adjacent abrasive composite shapes. Similarly, the rotogravure roll can impart a pattern such that there is a mixture of abrasive composite shapes.

Another method is to spray or coat the curable abrasive composite layer through a screen to generate a pattern and the abrasive composites. Then the precursor polymer subunits are cured to form the abrasive composite structures. The screen can impart any desired pattern such as a hexagonal array, ridges, lattices, spheres, pyramids, truncated pyramids, cones, cubes, blocks, or rods. The screen may also impart a pattern such that there is a land area between adjacent abrasive composite structures. This land area can comprise a mixture of abrasive particles and binder. Alternatively, the screen may impart a pattern such that the backing is exposed between adjacent abrasive composite structures. Similarly, the screen may impart a pattern such that there is a mixture of abrasive composite shapes. This process is reported in U.S. Pat. No. 3,605,349 (Anthon), incorporated herein by reference.

Attachment System

The abrasive article of the invention may be secured to a support structure, commonly referred to as a backup pad. The abrasive article may be secured by means of a unitary mechanical attachment system such as a hook and loop attachment system.

The attachment system must have sufficient adhesive strength to secure the coated abrasive to a support pad during use.

The back side of the shaped backing includes a unitary part of a mechanical fastening system such as a flattened stem part or a hook part. These hooks or flattened stems will then provide the engagement between the coated abrasive article and a support pad that contains a loop fabric.

Test Procedures

The following test procedures were used to evaluate resin compositions and coated abrasive articles of the present invention.

Wet SCHIEFER Test

Abrasive coatings were laminated to a sheet-like backing bearing flattened engaging projections available from Minnesota Mining and Manufacturing Company (3M) under the trade designation HOOKIT™ II backing and converted into 10.16 cm (4-inch) discs. The back-up pad was secured to the driven plate of a Schiefer Abrasion Tester, available from Frazier Precision Company, Gaithersburg, Md., which had been plumbed for wet testing. Disc shaped acrylic plastic workpieces, 10.16 cm (4-inch) outside diameter by 1.27 cm (0.5-inch) thick, available under the trade designation "POLYCAST" acrylic plastic were obtained from Sielye Plastics (Bloomington, Minn.). The water flow rate was set to 60 grams per minute. A 454 grams (one-pound) weight was placed on the abrasion tester weight platform and the mounted abrasive specimen lowered onto the workpiece and the machine turned on. The machine was set to run for 90 cycles in 30 cycle intervals. Surface finish values $R_z$ were measured at four locations on the workpiece for each 30 cycle interval, with each test sample run in triplicate.

Panel Test 15.2 cm (6-inch) diameter circular specimens were cut from the abrasive test material and attached to a DYNABRADE model 56964 fine finish sander, available from Dynabrade Co., Clarence, N.Y. Abrasion tests were run for a total of one minute, in 10, 20 and 30 second intervals over three adjacent sections of the test panel, at an air pressure of 344 kPa (50 psi). The test panels were black base coat/clear coat painted cold rolled steel panels (E-coat: ED5000; Primer: 764-204; Base coat: 542AB921; Clear coat: RK8010A), obtained from ACT Laboratories, Inc., Hillsdale, Mich. Surface finish values $R_z$ were measured at five points on each test panel section, with each test sample run in triplicate.

Surface Finish $R_z$ is the average individual roughness depths of a measuring length, where an individual roughness depth is the vertical distance between the highest point and the lowest point.

The surface finish of abraded workpieces by the Wet Schiefer Test and Panel Test were measured using a profilometer under the trade designation "PERTHOMETER MODEL M4P," from Marh Corporation, Cincinnati, Ohio.

EXAMPLES

The following abbreviations are used in the examples. All parts, percentages and ratios in the examples are by weight unless stated otherwise:

| | |
|---|---|
| AMOX | di-t-amyloxalate |
| CHDM | cyclohexanedimethanol, available from Eastman Chemical Company, Kingsport, CT. |
| COM | η-[xylenes (mixed isomers)]-η-cyclopentadienyliron(II)-hexafluoroantimonate |
| CYRACURE 6110 | a cycloaliphatic epoxide resin, trade designation "CYRACURE 6110", available from Union Carbide Corp., Hahnville, LA. |
| EPON 828 | a bisphenol-A epoxy resin trade, designation "EPON 828," having an epoxy equivalent wt. of 185–192, available from Shell Chemical, Houston, TX. |
| EPON 1001F | a bisphenol-A epichlorohydrin based epoxy resin, trade designation "EPON 1001F," having an epoxy equivalent wt. of 525–550, available from Shell Chemical, Houston, TX. |
| DAROCUR 1173 | 2-hydroxy-2-methylpropiophenone, trade designation DAROCUR 1173, available from Ciba Specialty Chemicals, Tarrytown, NY |
| IRGACURE 651 | 2,2-dimethoxy-1,2-diphenyl-1-ethanone, trade designation "IRGACURE 651," available from Ciba Geigy Company, Ardsley, NY |
| MINEX-3 | anhydrous sodium potassium alumino silicate, trade designation "MINEX-3," available from L. V. Lomas, Ltd, Brampton, Ontario, Canada. |
| P320 FRPL | P320 grade aluminum oxide, trade designation "ALUDOR FRPL", available from Treibacher Chemische Werke AG, Villach, Austria. |
| P400 FRPL | P400 grade aluminum oxide, trade designation "ALUDOR FRPL", available from Treibacher Chemische Werke AG, Villach, Austria. |
| S-1227 | a high molecular weight polyester under the trade designation "DYNAPOL S-1227", available from Creanova, Piscataway, NJ. |
| TMPTA | trimethylol propane triacrylate, available under the trade designation "SR351" from Sartomer Co., Exton, PA. |
| UVI-6974 | triaryl sulfonium hexafluoroantimonate, 50% in propylene carbonate, available from Union Carbide Corp. Hahnville, LA. |
| CN973J75 | urethane-acrylate resin from Sartomer, Inc., Exton, PA. |
| F80 | expandable polymeric microspheres, trade designation "MICROPEARL F80-SD1," available from Pierce-Stevens Corp., Buffalo, NY. |
| SR339 | 2-phenoxyethyl acrylate from Sartomer, Inc., Exton, PA. |

-continued

| | |
|---|---|
| PD9000 | anionic polyester dispersant, trade designation "ZEPHRYM PD 9000," available from Uniqema, Wilmington, DE. |
| A-174 | γ-methacryloxypropyltrimethoxy silane, trade designation "SILQUEST A-174," available Crompton Corp., Friendly, WV. |
| TPO-L | phosphine oxide, trade designation "LUCIRIN TPO-L," available from BASF Chemicals, Ludwigshafen, Germany. |
| GC2500 | green silicon carbide mineral, grade JIS2500, available from Fujimi Corp. Elmhurst, IL. |

Example 1

Simultaneously Preparation of Shaped Features and Mechanical Attachment Elements A shaped backing was formed using a process and apparatus such as illustrated in FIG. 1. The patterned silicone belt (15) contained stem-forming holes. The holes were 0.0406 cm (0.016 inch) in diameter and 0.1778 cm (0.070 inch) deep with a cross web spacing of 0.1410 cm (0.0555 inch) and a machine direction spacing of 0.13759 cm (0.05417 inch). The cross web holes were offset 0.0706 cm (0.0278 inch) from each neighboring row of cross web holes. The belt temperature was 65.6° C. (150° F.). The top steel roll (14) was embossed with a microreplicated pattern that came in contact to the opposing side of the stem web. The patterned roll was temperature controlled to 18.3° C. (65° F.).

A 35.6–40.6 cm (14–16 inch) wide molten sheet of polypropylene, available under the trade designation "SRD7587" from Dow Chemical Co., Midland, Mich. was extruded at 248.9° C. (480° F.) from a dual manifold sheet die but only fed from a single manifold by a 3.81 cm (1.5 inch) single-screw extruder (10) (from Johnson Plastic Machinery Co., Chippewa Falls, Wis.), having an L/D of 29/1 and operating at 61 rpm. The Johnson extruder had a temperature profile ranging from 225° C. (400° F.) at the feed zone to 248.9° C. (480° F.) at the discharge zone, with adapter temperatures at 248.9° C. (480° F.). The Johnson extruder screw was of a general purpose single flight design. The die temperature was 248.9° C. (480° F.). The molten polypropylene was introduced into the nip between the patterned steel roll 14 and silicone belt 15 that were rotating at 8.2 meters (27 feet) per minute. The nip pressure was 137.9 kPa (20 psi). The molten polymer was solidified by the chilled, patterned-roll surfaces 18.3° C. (65° F.), the belt-made stem web with patterned opposed side released onto a TEFLON™ covered roll. The substrate, thus produced, was about 0.254 mm (10 mil) thick, having raised and depressed areas on one surface and an opposite surface which bore 0.75 mm (30 mils) stalks, each having a diameter on the order of 0.4 mm (17 mils).

As depicted in FIG. 1, the shaped backing was passed through a capping station provided by a set of three 25.4 cm (10 inch) diameter rolls (25, 26 and 27) stacked adjacent one another to provide nip gaps on the order of 0.5 mm (20–25 mils) between adjacent rolls with the outer rolls of the set being heated at 150° C. (300° F.) and the inner roll being cooled to 10° C. (50° F.) at a web speed of 8.2 meters per minute to create, at the end of each stalk, a 0.76 mm (30 mil) diameter cap having a thickness on the order of 0.1 mm (4 mils). The shaped backing so processed was wound on a take-up roll 30 for further processing, including corona priming of the surface on which the abrasive coating was to be applied.

A make resin was prepared as follows: EPON 1001F pellets (25%) and DYNAPOL S-1227 pellets (28%) were compounded with a premix. The premix contains the following: EPON 828 resin (34.5%), IRGACURE 651 (1%), CHDM (2.8%), TMPTA (7.5%), AMOX (0.6%) and COM (0.6%). The materials (EPON 1001F, DYNAPOL S1227, and the premix) were combined in a twin-screw extruder.

The make resin was extrusion coated at 105° C. and a rate of 20 g/m$^2$ to the surface of the shaped structures of the shaped backing prepared as described above in Example 1 and partially cured by passing once through a UV Processor, trade designation "EPIQ 6000," available from Fusion Systems Corp., Rockville, Md., with a FUSION V bulb at 0.1–0.5 J/cm$^2$ and 36 m/min. P400 FRPL aluminum oxide was then applied electrostatically at 45 g/m$^2$ and further cured at a temperature range of 77–122° C.

A size coat was prepared as follows: TMPTA (22.8%) and CYRACURE 6110 (22.8%), EPON 828 (30.4%), UVI-6974 (3%), DAROCUR 1173 (1.0%) and MINEX-3 (20%) were added. The size was roll coated at 24 g/m$^2$ and cured by passing through the UV processor at 36 m/min. using a FUSION D bulb at 0.1–0.5 J/cm$^2$ and then thermally cured at a temperature range of 110–120° C.

Example 2

Microreplicated polypropylene toolings, having the mirror-image 3-dimensional pattern of the desired shaped backing features and shaped abrasive composite features described below, were made according to U.S. Pat. No. 5,435,816 (Spurgeon et al.), incorporated herein by reference, using 48 cm×48 cm stainless steel master toolings. These master toolings were made via a masking/chemical etching process. From these master toolings, reverse-image polypropylene toolings were made using the following process: In a 135° C. heated press, a metal master tooling was placed on the bottom platen. On top of the tooling was placed a 0.8 mm thick sheet of polypropylene followed by a 3 mm thick aluminum plate. The composite was pressed at 618 kPa (90 psi) for 3 minutes and then removed. The mirror-image of the master tooling was molded into the polypropylene sheet. This molded polypropylene sheet was subsequently used as the tooling mold to produce the non-abrasive shaped structures on the backing.

Pre-mix #1: 60.8 parts CN973J75, 36.4 parts SR339 and 2.8 parts TPO-L were combined using a mixer, available under the trade designation DISPERSATOR from Premier Mill Corp., Reading, Pa., at room temperature until air bubbles had dissipated.

Slurry #1: 3.4 parts of pre-expanded F80 was then added to 96.6 parts of Pre-mix #1 and formed into homogeneous slurry #1 using the DISPERSATOR mixer. F80 microspheres were pre-expanded at 160° C. for 60 minutes before use.

Slurry #1 was then applied, via hand spread, to a microreplicated tooling having square posts in an array as shown in FIG. 9, 1.3 mm×1.3 mm×0.356 mm deep, with a 22% bearing area, as described in Table 2. The slurry filled tooling was then laminated face down to the smooth side of corona treated 3M HOOKIT™ II backing by passing through a set of rubber nip rolls at 26 cm/min. and a nip pressure of 275 kPa (40 psi). The slurry was then cured by passing twice through a UV processor, available from American Ultraviolet Company, Murray Hill, N.J., using two V-bulbs in sequence operating at 157.5 watts/cm (400 W/inch) and a web speed of 914 cm/min. The tooling was then removed to reveal a large scale 3-dimensional cured polymer foam structure having the mirror image of the tooling.

Pre-Mix #2: 33.6 parts SR339 was mixed by hand with 50.6 parts TMPTA, into which 8 parts PD 9000 was added and held at 60° C. until dissolved. The solution was cooled to room temperature. To this was added 2.8 parts TPO-L and 5 parts A-174 and the mixture again stirred until homogeneous.

Slurry #2: 61.5 parts GC2500 was incorporated into 38.5 parts of pre-mix #2 using the dispersator mixer to form homogeneous slurry #2.

The abrasive slurry was then applied, via hand spread, to a polypropylene microreplicated tooling, as depicted in FIGS. 6 and 7 wherein: s=55 μm; t=250 μm; w=99.53°; x=54.84 μm, y=55 μm; z=53.00°. The abrasive slurry filled tooling and was then laminated face down on the 3M HOOKIT™ II backed large scale 3-dimensional coated structure by passing through a set of rubber nip rolls at 26 cm/min and a nip pressure of 275 kPa (40 psi). The slurry was then cured by passing twice through the UV Processor using two V-bulbs in sequence operating at 157.5 watts/cm (400 W/inch) and a web speed of 914 cm/min. On the first pass a 6 mm quartz plate was placed over the laminate in order to maintain pressure on the laminate. The tooling was then separated from the backing to reveal a cured 3-dimensional abrasive coating on top of a 3-dimensional foam structure.

Example 3

A 3-dimensional abrasive coating on top of a 3-dimensional foam structure was prepared as outlined in Example 2, where in slurry #1 was applied to a microreplicated tooling having square posts in an array as depicted in FIG. 9, 10 mm×10 mm×0.533 mm deep, with a 90% bearing area, as described in Table 3. The tooling was made according to the process described in Example 2.

Comparative Sample

A coated abrasive foam disc, grade P3000, available under the trade designation 4435A TRIZACT HOOKIT™ II, from 3M Company, St Paul, Minn.

Abrasion Tests

Results of Wet SCHIEFER test is listed in Table 1.

TABLE 1

| | Wet SCHIEFER Test | | | |
|---|---|---|---|---|
| Example | $R_z$-Initial μm (μ-inches) | $R_z$ @ 30 Cycles μm (μ-inches) | $R_z$ @ 60 Cycles μm (μ-inches) | $R_z$ @ 90 Cycles μm (μ-inches) |
| Comparative Sample | 70.3 (1.79) | 30.0 (0.76) | 27.9 (0.71) | 27.5 (0.70) |
| 2 | 65.8 (1.67) | 30.1 (0.77) | 23.0 (0.58) | 19.9 (0.51) |
| 3 | 67.4 (1.71) | 32.1 (0.82) | 20.0 (0.51) | 21.0 (0.53) |

Table 2, read in conjunction with FIG. 9 sets forth the tooling dimensions for Examples 2 and 3.

TABLE 2

| Example | Tooling Dimensions (mm) | Bearing Area (%) | Reference FIG. |
|---|---|---|---|
| 2 | a = 1.3, b = 1.5, height = 0.356 | 22 | 9 |
| 3 | a = 10.0, b = 0.5, height = 0.533 | 90 | 9 |

Example 4

Slurry #1 was then applied, via hand spread, to a microreplicated tooling having square posts, 2.6 mm×2.6 mm×0.533 mm deep, with a 42% bearing area. The slurry filled tooling was then laminated face down to the smooth side of corona treated 3M HOOKIT™ II backing by passing through a set of rubber nip rolls at 26 cm/min. and a nip pressure of 275 kPa (40 psi). The slurry was then cured by passing twice through a UV processor, available from American Ultraviolet Company, Murray Hill, N.J., using two V-bulbs in sequence operating at 157.5 watts/cm (400 W/inch) and a web speed of 914 cm/min. The tooling was then removed to reveal a large scale 3-dimensional cured polymer foam structure having the mirror image of the tooling.

A make resin was prepared as follows: EPON 1001F pellets (25%) and DYNAPOL S-1227 pellets (28%) were compounded with a premix. The premix contains the following: EPON 828 resin (34.5%), IRGACURE 651 (1%), CHDM (2.8%), TMPTA (7.5%), AMOX (0.6%) and COM (0.6%). The materials (EPON 1001F, DYNAPOL S1227, and the premix) were combined in a twin-screw extruder.

The make resin was extrusion coated at 105° C. and a rate of 20 g/m$^2$ to the surface of the shaped backing structures and partially cured by passing once through a UV Processor, trade designation "EPIQ 6000", available from Fusion Systems Corp., Rockville, Md., with a Fusion V bulb at 0.1–0.5 J/cm$^2$ and 30 m/min. P320 FRPL aluminum oxide was then applied electrostatically at 70 g/m$^2$ and further cured at a temperature range of 77–122° C.

Figure 10:
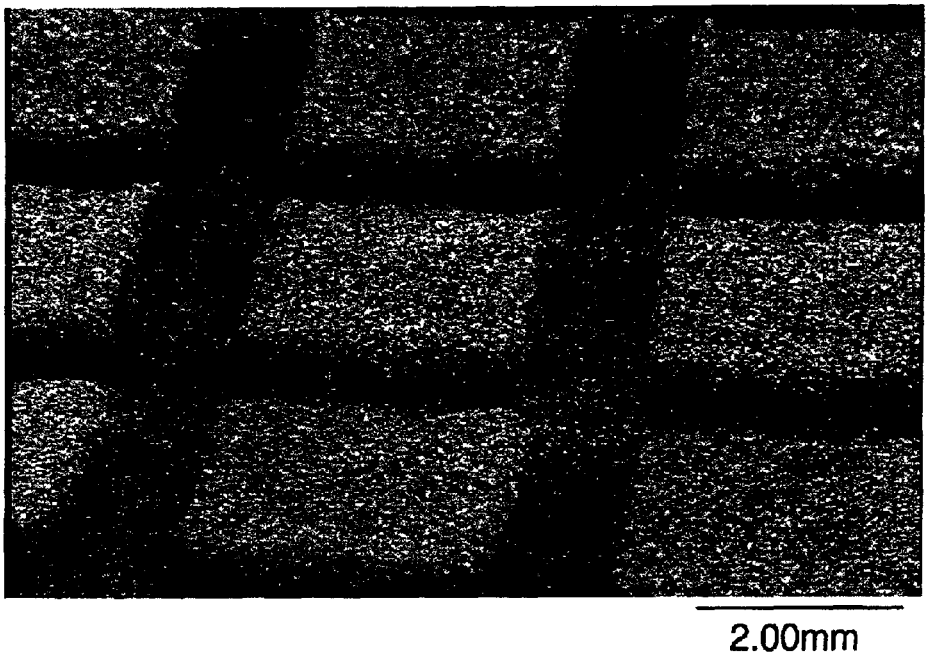
FIG. 10 is an optical photomicrograph of an abrasive article of the present invention.

A size coat was prepared as follows: TMPTA (22.8%) and CYRACURE 6110 (22.8%), EPON 828 (30.4%), UVI-6974 (3%), Darocur 1173 (1.0%) and MINEX-3 (20%) were added. The size was roll coated at 31 g/m$^2$ and cured by passing through the UV processor at 30 m/min. using a Fusion D bulb at 0.1–0.5 J/cm$^2$ and then thermally cured at a temperature range of 110–120° C. FIG. 10 shows a photomicrograph of the top surface of the abrasive article made by Example 4.

Example 5

Figure 11:
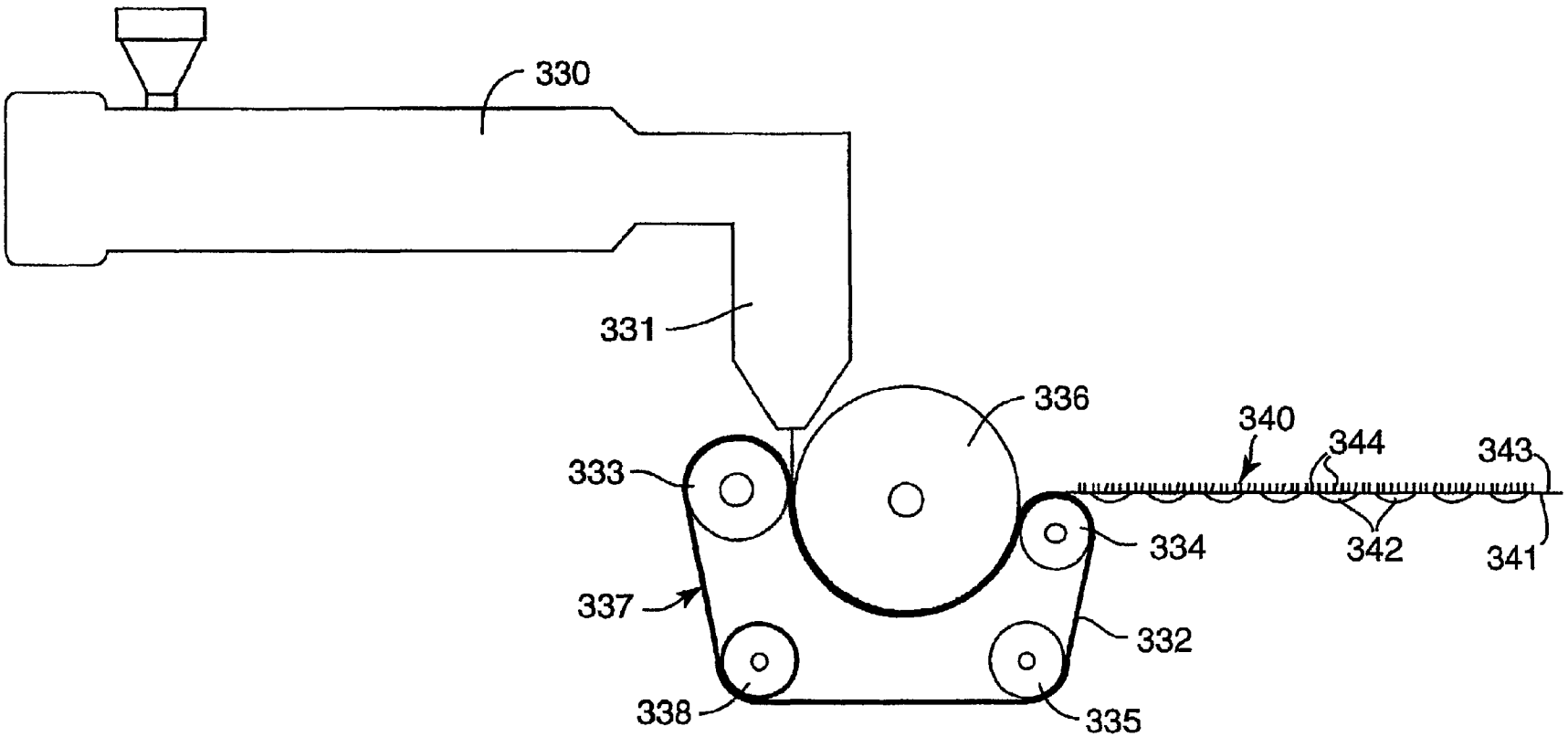
FIG. 11 is a schematic drawn representation depicting a preferred process and apparatus for forming the backing of the invention.
Figure 12:
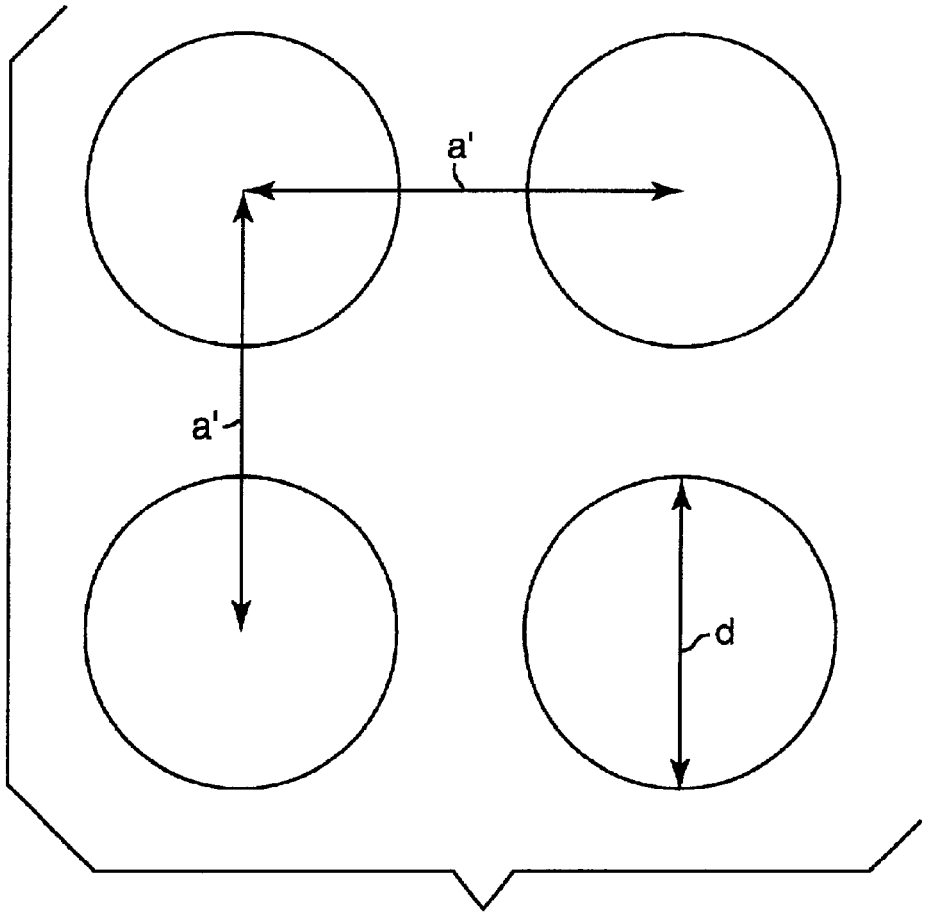
FIG. 12 depicts detailed information regarding the size and spacing of the cavities in the production tool depicted in FIG. 11.

A substrate was formed using a process and apparatus such as illustrated in FIG. 11. A silicone belt 337 with a contact surface having a pattern of domed features 332 was wrapped around roll set 333, 334, 335 and 338, respectively, including two nip rolls, 333 and 334, respectively, and under the casting roll 336. FIG. 12 shows the spacing of the features of the pattern. As shown in FIG. 12, the base diameter, d, of the dome was 7.4 mm and the height (not identified in FIG. 12) was 1.3 mm. Each dome was positioned a distance, a', that being 10.5 mm from the other (center point to center point) in both the cross web and down web directions. The casting roll 336 was wrapped with a silicone belt containing stem-forming holes. The holes were 0.0406 cm (0.016 inch) in diameter and 0.1778 cm (0.070 inch) deep with a cross web spacing of 0.1410 cm (0.0555 inch) and a machine direction spacing of 0.13759 cm (0.05417 inch). The cross web holes were offset 0.0706 cm (0.0278 inch) from each neighboring row of cross web holes. The cast roll temperature and the belt temperature were both 21.1° C. (70° F.).

Figure 13:
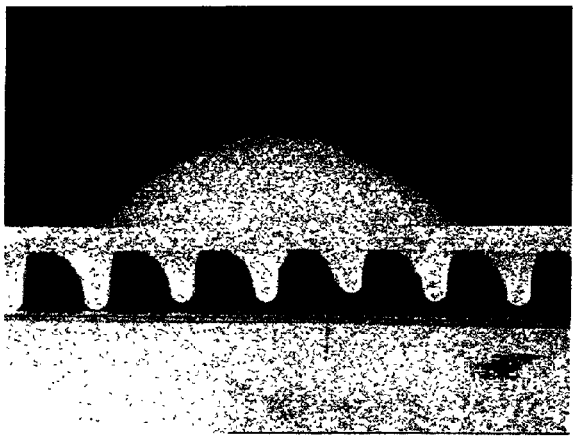
FIG. 13 is a photomicrograph of a cross-section of the backing produced by use of the apparatus depicted in FIG. 11.

A molten sheet of polypropylene (SRD7587 from Dow Chemical Company, Midland, Mich.) was extruded at 248.9° C. (480° F.) from a 0.356 m (14 inch) wide EBR film die (331) (available from Cloeren Inc., Orange, Tex.) fed from a Model DS-25, 0.064 m (2.5 inch) diameter single screw extruder 330 (available from Davis Standard Corporation, Pawcatuck, Conn.) having an L/D ratio of 24/1 and operating at 15 rpm. The extruder had a temperature profile ranging from 187.7° C. (370° F.) at the feed zone to 248.9° C. (480° F.) at the discharge zone, with adapter temperatures at 248.9° C. (480° F.). The die temperature was 248.9° C. (480° F.). The molten polypropylene was introduced into the nip between the casting roll with the stem-forming belt wrapped around casting roll 336 and the dome patterned coating surface 332 of belt 337 that were rotating at 1.2 meters (4 feet) per minute. The nip pressure was 103.4 kPa (15 psi). The belt tension was 172.4 kPa (25 psi). The resultant backing substrate 340, thus produced, had a base thickness that ranged from 0.228 mm (9 mils) to 0.279 mm (11 mils). The first surface 341 had a domed feature pattern, with each dome 342 having a base diameter of 7.4 mm, and height of 1.3 mm. The second surface 343 had a plurality of 0.889 mm (35 mils) stalks 344, each having a diameter on the order of 0.4 mm (17 mils). FIG. 13 shows a photomicrograph of the resultant backing. The substrate so processed was wound on a take-up roll (not shown) for further processing to form the mechanical fastener and applying an abrasive coating.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A backing for an abrasive article comprising a sheet-like polymeric substrate having a first major surface including a pattern of non-abrasive raised areas and depressed areas for supporting an abrasive coating at least over said raised areas and an opposite second major surface including a plurality of shaped engaging elements formed of the same polymeric material as the substrate that are one part of a two-part mechanical engagement system, said shaped engaging elements being selected from the group consisting of a) filament stems having flattened or rounded distal ends unitarily shaped into said second major surface and b) hook elements unitarily shaped into said second major surface.

2. The backing of claim 1 wherein said pattern on said first major surface is a uniform pattern.

3. The backing of claim 1 wherein said shaped engaging elements comprise filament stems having flattened distal ends integrally shaped into said second major surface.

4. The backing of claim 1 wherein said shaped engaging elements comprise hook elements integrally shaped into said second major surface.

5. An abrasive article comprising:

a) a backing comprising a sheet-like polymeric substrate having a first major surface, including a pattern of non-abrasive raised areas and depressed areas for supporting an abrasive coating at least over said raised areas and an opposite second major surface including a plurality of shaped engaging elements formed of the same polymeric material as the substrate that are one part of a two-part mechanical engagement system, said shaped engaging elements being selected from the group consisting of b) filament stems having flattened or rounded distal ends unitarily shaped into said second major surface and c) hook elements unitarily shaped into said second major surface; and d) an abrasive coating at least over said raised areas.

6. The abrasive article of claim 5 wherein said abrasive coating comprises abrasive particles and a binder.

7. The abrasive article of claim 6 wherein said abrasive coating has a shaped abrasive surface comprising raised areas and depressed areas.

8. The abrasive article of claim 5 wherein said pattern on said first major surface is a uniform pattern.

9. The abrasive article of claim 5 wherein said pattern on said first major surface is a random pattern.

10. The abrasive article of claim 5 wherein shaped engaging elements comprise filament stems having flattened distal ends unitarily shaped into said second major surface.

11. The abrasive article of claim 5 wherein said shaped engaging elements comprise hook elements unitarily shaped into said second major surface.

12. The abrasive article of claim 5 wherein said abrasive coating comprises a binder make coating into which at least a portion of each abrasive particle is embedded.

13. The abrasive article of claim 12 wherein the make coating is a binder selected from the group consisting of acrylate resins, epoxy resins, nitrile rubber resins, urethane resins, aminoplast resins, phenolics resins, urea-formaldehyde resins, polyvinyl chloride resins and butadiene rubber resins.

14. The abrasive article of claim 12 further includes a size coating over said make coating and said abrasive particles.

15. The abrasive article of claim 14 wherein the size coating is a binder resin selected from the group consisting of phenolic resins, aminoplast resins having pendant $\alpha,\beta$-unsaturated carbonyl groups, urethane resins, epoxy resins, ethylenically unsaturated resins, ethylenically unsaturated resins, acrylated isocyanurate resins, urea formaldehyde resins, isocyanurate resins, acrylated urethane resins, acrylated epoxy resins, bis-maleimide resins, fluorine-modified resins, and combinations thereof.

16. The abrasive article of claim 5 wherein abrasive particles comprise material selected from the group consisting of fused alumina, silicon carbide, alumina-based ceramics, zirconia, alumina-zirconia, diamond, ceria, cubic boron nitride, garnet, ground glass, quartz, and combinations thereof.

* * * * *

UNITED STATES PATENT AND TRADEMARK OFFICE

CERTIFICATE OF CORRECTION

PATENT NO. : 6,846,232 B2
DATED : January 25, 2005
INVENTOR(S) : Braunschweig, Ehrich J.

It is certified that error appears in the above-identified patent and that said Letters Patent is hereby corrected as shown below:

Title page,
Item [56], References Cited, FOREIGN PATENT DOCUMENTS, delete "0 302 162 B1" and insert -- 0 306 162 B1 --, therefor Column 1,
Line 39, after "itself" insert -- . --.

Column 32,
Line 27, after "flattened" insert -- or rounded --.

Signed and Sealed this

Twenty-eighth Day of June, 2005

JON W. DUDAS
*Director of the United States Patent and Trademark Office*